US006935733B2

(12) United States Patent
Fukuda et al.

(10) Patent No.: US 6,935,733 B2
(45) Date of Patent: Aug. 30, 2005

(54) FIXING BELT, FIXING ROLLER, PRODUCTION METHOD THEREOF, FIXING APPARATUS AND IMAGE FIXING METHOD UTILIZING THE APPARATUS

(75) Inventors: Teruyuki Fukuda, Hachioji (JP); Shuji Kida, Iruma (JP); Shinichi Suzuki, Saitama (JP); Hidenobu Ohya, Hachioji (JP); Makoto Kaga, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/360,352

(22) Filed: Feb. 7, 2003

(65) Prior Publication Data

US 2003/0169323 A1 Sep. 11, 2003

(30) Foreign Application Priority Data

Feb. 13, 2002 (JP) ..... 2002-035205

(51) Int. Cl.[7] ..... B41J 2/01

(52) U.S. Cl. ..... 347/101; 347/102; 347/103

(58) Field of Search ..... 347/101, 102, 347/103, 104; B41J 2/01

(56) References Cited

U.S. PATENT DOCUMENTS

| | | | | | |
|---|---|---|---|---|---|
| 4,832,984 | A | * | 5/1989 | Hasegawa et al. | 427/161 |
| 4,889,576 | A | * | 12/1989 | Suganuma et al. | 156/249 |
| 5,783,348 | A | * | 7/1998 | Tyagi et al. | 430/124 |
| 5,907,348 | A | * | 5/1999 | Ogasawara et al. | 347/212 |
| 6,526,859 | B1 | * | 3/2003 | Ozawa et al. | 87/35 |

* cited by examiner

*Primary Examiner*—Manish Shah
*Assistant Examiner*—Leonard Liang
(74) *Attorney, Agent, or Firm*—Lucas and Mercanti

(57) ABSTRACT

A fixing belt for fixing an ink-jet image recorded on an ink-jet recording material, the fixing belt including a base material having thereon a base-surface modifying layer and a releasing layer in the order, wherein the base-surface modifying layer has a pencil hardness of HB or a higher hardness and the releasing layer includes a silicone resin.

13 Claims, 4 Drawing Sheets

FIXING BELT, FIXING ROLLER, PRODUCTION METHOD THEREOF, FIXING APPARATUS AND IMAGE FIXING METHOD UTILIZING THE APPARATUS

FIELD OF THE INVENTION

The present invention relates to a fixing belt and a fixing roller, a production method of the same, as well as a thermal fixing apparatus and an image fixing method utilizing the same.

BACKGROUND OF THE INVENTION

Ink-jet recording is carried out in such a manner that minute ink droplets are allowed to jet utilizing various working principles, and to allow said ink droplets to adhere onto a recording material so that images as well as text are recorded. Ink-jet recording exhibits advantages of relatively high speed, low noise, and ease of multicolor printing.

Further, being based on the recent technical progress, pigment ink, comprising pigments, which exhibit excellent lightfastness, a colorant, has received increasing attention as ink for application requiring images with excellent lightfastness.

Pigments are not soluble in solvents. As a result, pigments are dispersed into solvents and are employed in ink in the form of a dispersed state. Therefore, even when the molecules on the surface of dispersed pigment particles results in photochemical decomposition, any new pigment molecular layer under the decomposed layer is exposed. As a result, a decrease in apparent density is minimized. Therefore, said pigment ink is characterized in that excellent image retention properties are achieved.

However, said pigment ink has caused problems in that after image fixing, it is difficult to create high gloss images due to effects of scattered light, as well as reflected light caused by said pigment particles.

Still further, Japanese Patent Publication Open to Public Inspection No. 5-265337 discloses that in a fixing belt comprising a base material having on its surface a releasing layer, said belt is characterized in that said releasing layer is comprised of a silicone resin. However, a silicone resin layer is directly coated on the base material and the formed layer is not strongly adhered to the base.

Japanese Patent Publication Open to Public Inspection No. 2000-112271 discloses a fixing belt having a releasing layer comprising a hardenable modified silicone resin on the outermost surface (which corresponds to a releasing layer) of the support material.

However, there was such a problem, in which a fixing part material became an elastic body and smoothness of a recorded material was reduced even provided with a rigid silicone resin as the outermost layer, because an elastic layer was provided between a surface layer and a base material. Further, although there is a description with respect to an adhesive layer, it does not contribute to improve adhesion of a surface layer because of the constitution in which the adhesive layer is provided between an elastic layer and a base material.

According to Japanese Patent Publication Open to Public Inspection No. 2001-222176, adhesion strength was improved by utilizing a metal alkoxide in an adhesive layer of a fixing belt for electrophotography, however, there was such a problem in which releasing property was insufficient as a fixing part material for ink jet recording images because a metal alkoxide had been added also in a releasing layer of the fixing belt. Further, there was such a problem, particularly in case of fixing an ink jet recording material, in which ink jet ink solvents permeated into the adhesive layer resulting in marked reduction of adhesion strength.

There may occur problems in which swelling rate of the layer changes depending on the used and unused portions of a fixing belt or a fixing roller resulting in that that gloss is exhibited differently between the repeatedly used portion and the unused portion; concretely, there caused problems in which gloss varies in an identical image when a large size image is fixed after a photographic size image has been repeatedly fixed, and glossiness changes from the beginning to the latter resulting in insufficient consistency of quality.

SUMMARY OF THE INVENTION

An object of the present invention is to provide a fixing belt and a fixing roller which result in excellent image gloss after fixing with a small amount of glossiness change, and result in neither layer peeling of the fixing member during thermal fixing nor offsetting, a production method of the same, a thermal fixing apparatus, and an image forming method.

The aforementioned object of the present invention was achieved employing the embodiments described below.

1. A fixing belt for fixing an ink-jet image recorded on an ink-jet recording material, the fixing belt comprising a base material having thereon a base-surface modifying layer and a releasing layer in the order, wherein the base-surface modifying layer has a pencil hardness of HB or a higher hardness and the releasing layer comprises a silicone resin.

2. The fixing belt of item 1, wherein the releasing layer has a durometer hardness defined by JIS K 6253 of not less than 90.

3. The fixing belt of item 2, wherein the base-surface modifying layer has a swelling rate in an ink for ink-jet recording of less than 5 weight %.

4. The fixing belt of item 2, wherein the base-surface modifying layer comprises an aluminum coupling agent or a zirconium coupling agent.

5. The fixing belt of item 2, wherein an adhesive layer is further provided between the base-surface modifying layer and the releasing layer.

6. The fixing belt of item 5, wherein the adhesive layer comprises a butyral resin.

7. The fixing belt of item 6, wherein the adhesive layer comprises a silane coupling agent.

8. The fixing belt of item 7, wherein the silane coupling agent has a terminal vinyl group.

9. The fixing belt of item 2, wherein the base material has a Young's modulus value of 50 to 300 kN/mm.

10. The fixing belt of item 2, wherein the base material comprises electric forming nickel and forms a seamless belt.

11. The fixing belt of item 9, wherein the releasing layer has a C value of not less than 85.

12. A method for producing the fixing belt of item 2, wherein the base-surface modifying layer is obtained by a process comprising the steps of:

(a) coating the base material with a coating liquid containing a base-surface modifying agent using a dip coating method; and (b) hardening the base-surface modifying agent coated on the base material.

13. A method for producing the fixing belt of item 2, wherein the base-surface modifying layer is obtained by a process comprising the steps of:

(a) coating the base material with a coating liquid containing a base-surface modifying agent using a dip coating method;

(b) hydrolyzing the base-surface modifying agent coated on the base material under a humid condition; and (c) condensating the hydrolyzed surface modifying agent under a dry condition.

14. A fixing roller for fixing an ink-jet image recorded on an ink-jet recording material, the fixing roller comprising a base material having thereon a base-surface modifying layer and a releasing layer in the order, wherein the base-surface modifying layer has a pencil hardness of HB or a higher hardness and the releasing layer comprises a silicone resin.

15. The fixing roller of item 14, wherein the releasing layer has a durometer hardness defined by JIS K 6253 of not less than 90.

16. The fixing roller of item 15, wherein the base-surface modifying layer has a swelling rate in an ink for ink-jet recording of less than 5 weight %.

17. The fixing roller of item 15, wherein the base-surface modifying layer comprises an aluminum coupling agent or a zirconium coupling agent.

18. The fixing roller of item 15, wherein an adhesive layer is further provided between the base-surface modifying layer and the releasing layer.

19. The fixing roller of item 18, wherein the adhesive layer comprises a butyral resin.

20. The fixing roller of item 19, wherein the adhesive layer comprises a silane coupling agent.

21. The fixing roller of item 20, wherein the silane coupling agent has a terminal vinyl group.

22. The fixing roller of item 15, wherein the base material has a Young's modulus value of 50 to 300 kN/mm.

23. The fixing roller of item 22, wherein the base material is a metal.

24. The fixing roller of item 23, wherein the releasing layer has a C value of not less than 85.

25. A method for producing the fixing roller of item 14, wherein the base-surface modifying layer is obtained by a process comprising the steps of:

(a) coating the base material with a coating liquid containing a base-surface modifying agent using a dip coating method; and (b) hardening the base-surface modifying agent coated on the base material.

26. A method for producing the fixing roller of item 14, wherein the base-surface modifying layer is obtained by a process comprising the steps of:

(a) coating the base material with a coating liquid containing a base-surface modifying agent using a dip coating method;

(b) hydrolyzing the base-surface modifying agent coated on the base material under a humid condition; and (c) condensating the hydrolyzed surface modifying agent under a dry condition.

27. A heat fixing apparatus for fixing an ink-jet image recorded on an ink-jet recording material using the fixing belt of item 2.

28. A heat fixing apparatus for fixing an ink-jet image recorded on an ink-jet recording material using the fixing roller of item 14.

29. A heat fixing apparatus for fixing an ink-jet image recorded on an ink-jet recording material, wherein the ink-jet image is formed using a pigment ink.

30. The heat fixing apparatus of item 27, wherein the ink-jet recording material comprises a support having thereon an ink absorbing layer comprising inorganic particles and a surface layer comprising thermoplastic resin particles in the order.

31. The heat fixing apparatus of item 28, wherein the ink-jet recording material comprises a support having thereon an ink absorbing layer comprising inorganic particles and a surface layer comprising thermoplastic resin particles in the order.

32. A method for forming an ink-jet image using the heat fixing apparatus of item 25.

DETAILED DESCRIPTION OF THE INVENTION

Figure 1:
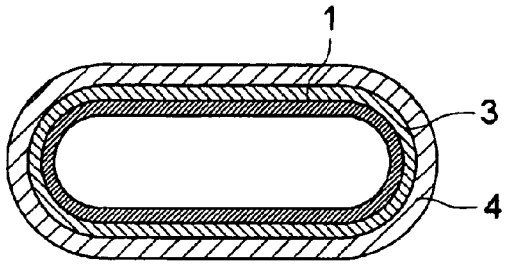
FIG. 1 is a schematic view showing a fixing belt.
Figure 2:
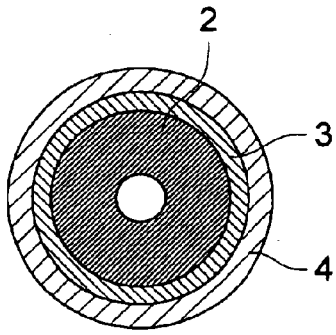
FIG. 2 is a schematic view showing a fixing roller.
Figure 3:
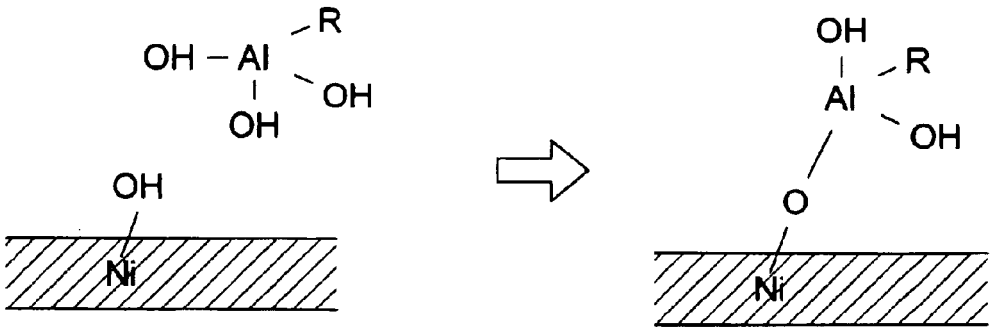
FIG. 3 is a schematic view showing a base-surface modifying mechanism.

An embodiment of examples of the present invention will hereinafter be explained according to figures. FIG. 1 shows a cross section of a fixing belt according to the present invention and FIG. 2 shows a cross section of a fixing roller according to the present invention. Symbol 1 represents a belt material and symbols 2 to 4 represent roller base material, a base material modifying layer and a releasing layer, respectively. A base material modifying layer is a layer which modify the surface of a base material, and, in an embodiment of examples, as shown in FIG. 3, hydroxyl groups of an aluminum coupling agent are condensed with hydroxyl groups included in an oxidized layer on a nickel base material, to form a strong bonding as well as to increase a density of a hydroxyl group per unit area. A releasing layer is essentially a non-elastic body, and has a hardness of not less than 90 based on a durometer hardness according to JIS K 6253. JIS K 6253 is a testing method having a title of "Hardness testing methods for rubber, vulcanized or thermoplastic". This standard is based on ISO 48 (Rubber, vulcanized or thermoplastic—Determination of hardness (hardness between 10 IRHD and 100 IRHD)) issued in 1994 and ISO 7619 (Rubber—Determination of indentation hardness by means of pocket hardness meters) issued in 1986.

Figure 4:
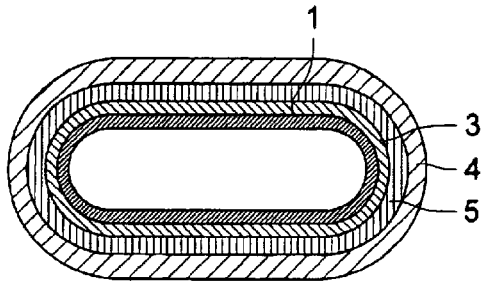
FIG. 4 is a schematic view showing a fixing belt having an adhesive layer.
Figure 5:
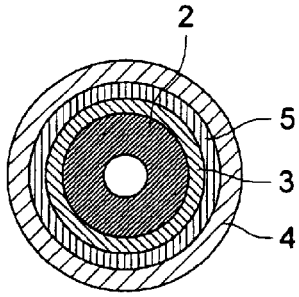
FIG. 5 is a schematic view showing a fixing roller having an adhesive layer.
Figure 6:
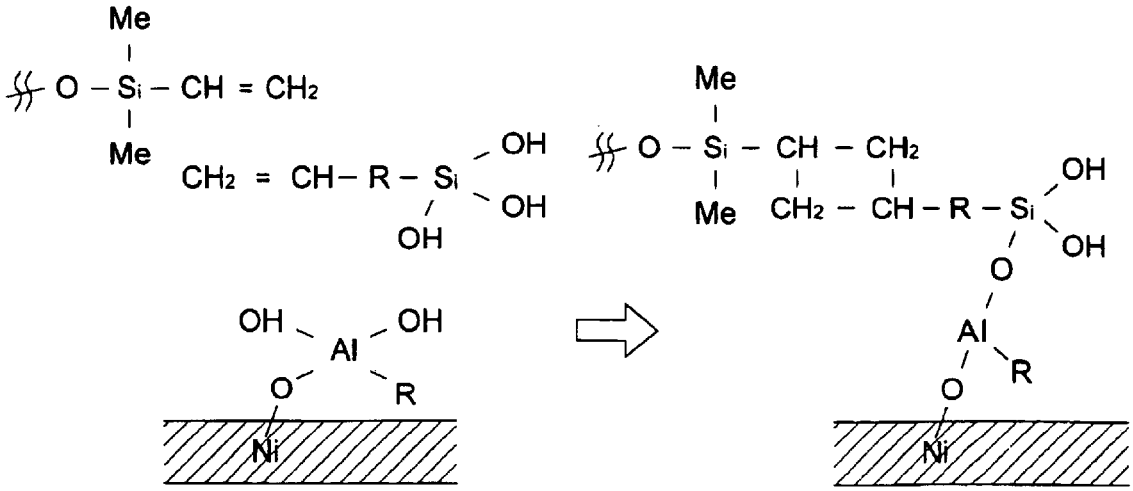
FIG. 6 is a schematic view showing a mechanism of a silane coupling agent.

FIG. 4 shows a fixing belt provided with adhesive layer 5 and FIG. 5 shows a fixing roller provided with adhesive layer 5, according to the present invention. An adhesive layer is a layer which chemically binds a base material modifying layer and a releasing layer, and in an embodiment of examples, as shown in FIG. 6, hydroxyl groups contained in a butyral resin and a silane coupling agent perform a condensation reaction with hydroxyl groups contained in a base material modifying layer, in addition that hydroxyl groups contained in a butyral resin and in a silane coupling agent and vinyl groups contained in a silane coupling agent perform an addition reaction with terminal vinyl groups of an addition polymerization type silicone, resulting in a strong adhesive power being exhibited. Since the adhesive power exhibited is based on covalent bonding, it never deteriorated by such as ink solvents.

Figure 7:
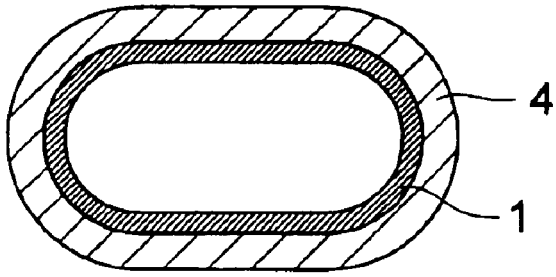
FIG. 7 is a schematic view showing a fixing belt having directly a releasing layer on the base material, which is not a fixing belt of the present invention.

FIG. 7 shows belt base material 1 provided with a releasing layer directly thereon, which does not belong to the present invention.

Figure 8:
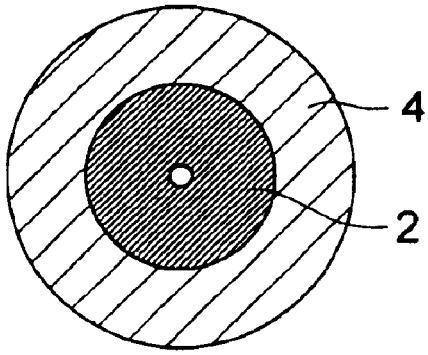
FIG. 8 is a schematic view showing a fixing roller having directly a releasing layer on the base material, which is not a fixing belt of the present invention.

FIG. 8 shows roller base material 2 provided with a releasing layer directly thereon, which does not belong to the present invention.

Figure 9:
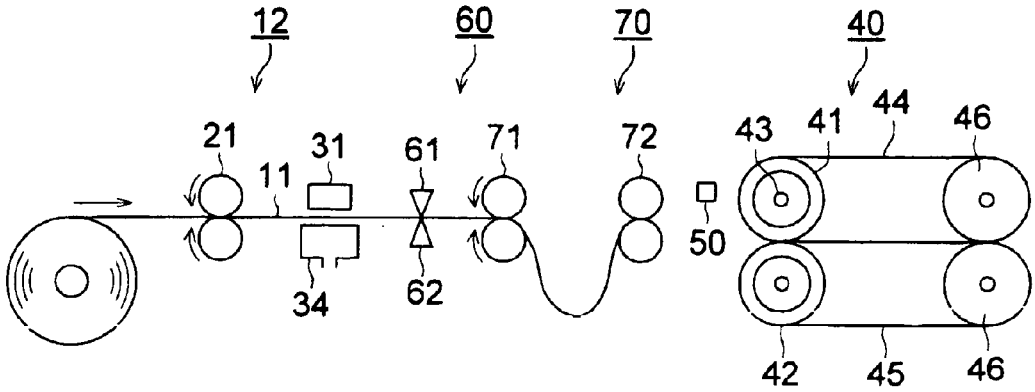
FIG. 9 is a schematic view showing one example of the structure of an ink-jet recording apparatus employed in the present invention.

FIG. 9 is a schematic view showing one example of the structure of an ink-jet recording apparatus employed in the present invention. In FIG. 9, recording material 11 fed from paired transport rollers 21 is subjected to ink-jet recording, employing printing head 31 and is then cut to a desired size, employing cutter 61. The resultant cut material is conveyed to first paired rollers and then to second paired rollers in a suspended state. Subsequently, said material is conveyed to thermal fixing means 40 and passed and then passed between heating roller 41, comprising heating body 43 in its interior, and pressure roller 42 together with fixing belt 44, whereby a thermal fixing treatment is carried out.

Figure 10:
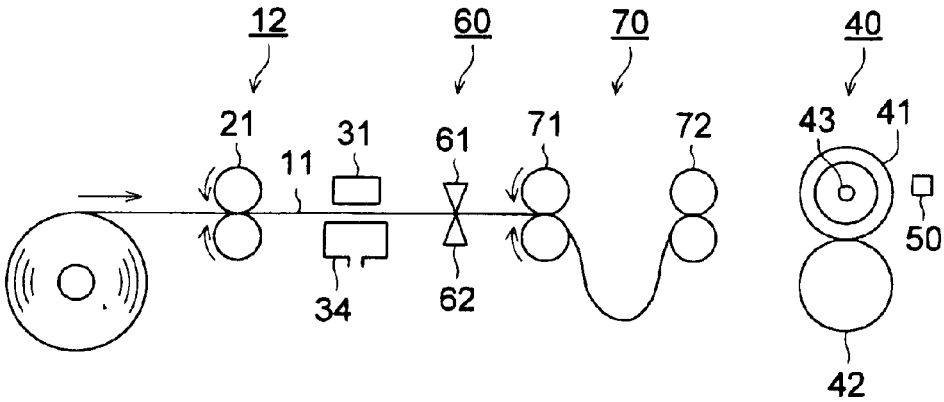
FIG. 10 is a schematic view showing another example of the structure of an ink-jet recording apparatus employed in the present invention.

FIG. 10 is a schematic view showing another example of the structure of the ink-jet recording apparatus employed in the present invention. In FIG. 10, recording material 11, fed from paired transport rollers 21, is subjected to ink-jet recording employing as printing head 31 and is cut to a desired size, employing cutter 61. The resultant cut material is conveyed to first paired rollers and then to second paired rollers in a suspended state. Subsequently, said material is conveyed to thermal fixing means 40 and passed between heating roller 41, comprising heating body 43 in its interior, and pressure roller 42, whereby a thermal fixing treatment is carried out.

The surface of said heating roller is provided with a releasing layer, though it is not shown, and the silicone resin according to the present invention is incorporated into said releasing layer.

The surface of said fixing belt, which comes into contact with said recording material 11, is provided with a releasing layer, though it is not shown, and said releasing layer comprises the silicone resin according to the present invention.

It has been found that the effect described in the present invention; that is to minimize glossiness variation of images after image formation, to cause no peel-off of a surface layer provided on a fixing belt or fixing roller (enhanced durability), as well as to depress off-set generation at fixing; can be achieved, as described in claim 1 or claim 6, by letting a recording material and a fixing belt or a fixing roller through between a heating mean and a pressure mean while facing the recording material against the surface layer side of the fixing belt or of the fixing roller provided with at least a base-surface modifying layer; and by providing a base material of a fixing belt or fixing roller, which perform fixing, with a base-surface modifying layer having a pencil hardness of HB or harder than HB, as well as by including a silicone resin in the foregoing surface layer.

<A Base-Surface Modifying Layer>

A base-surface modifying layer according to the present invention will be explained.

To achieve efficiently the effect described in the present invention, that is to minimize glossiness variation at image formation as well as to prevent a releasing layer from peeling-off at fixing, it is indispensable that a pencil hardness of a base-surface modifying layer defined by JIS K 5600-5-4 is not less than HB, and it is preferably in a range of from H to 5H and specifically preferably in a range of from 2H to 5H.

The pencil hardness of the base-surface modifying layer is an index to show (1) the strength of the bonding force of the molecules which constitutes the layer; and (2) the degree of cross-linking of the layer.

It is considered that highly adhesive and highly solid layer can be obtained when the strength of molecular bonding and the degree of cross-linking are higher.

Further, to prevent an unevenness of glossiness more effectively, a swelling rate defined by JIS K 6258 of a base-surface modifying layer is preferably not more than 5%, more preferably not more than 3% and specifically preferably in a range of not more than 1%. The swelling rate can be determined by measuring the change of weight value in an ink-jet ink.

The base-surface modifying layer having such a pencil hardness and a swelling ratio as described above preferably contains a surface modifying agent in respect to enhancing adhesion between a base material of a fixing belt or of a fixing roller and a releasing layer and preventing gloss unevenness at fixing suitably, and as the foregoing base-surface modifying agent, an aluminum coupling agent and a zirconium coupling agent are preferably utilized and more preferably an aluminum coupling agent.

The foregoing aluminum coupling agent or zirconium coupling agent has no adhesive property itself but has a function of enhancing adhesive property of the surface of a base material by hydrolysis/condensation reaction of the coupling agent when a surface of a material to be adhered (a base material of a fixing belt or of a fixing roller) is treated by the coupling agent solution.

Concrete examples of an aluminum coupling agent and a zirconium coupling agent are shown below, however, the present invention is not limited thereto.

Concrete Examples of an Aluminum Coupling Agent:

Acetomethoxy aluminum diisopropylate

Acetoethoxy aluminum diisopropylate

Acetoalkoxy aluminum diisopropylate

Aluminum di-n-butoxydo monomethylactate

Aluminum di-n-butoxydo monoethylacetate

Aluminum isopropylate

Mono-sec-butoxy aluminum diisopropylate

Aluminum sec-butylate

Aluminum ethylate

Ethylacetoacetate aluminum diisopropylate

Aluminum tris(ethylacetoacetate)

Alkylacetoacetate aluminum diisopropylate

Aluminum monoacetylacetoacetate bis(ethylacetoacetate)

Aluminum tris(acethylacetonate)

Aluminum monoisopropoxy monooleoxy ethylacetoacetate

Cyclic aluminum oxide isopropylate

Concrete Examples of a Zirconium Coupling Agent:

Zirconium tetraacetylacetate

Zirconium dibutoxy bisacetylacetonate

Zirconium tributoxyacetylacetate

Zirconium tetrakisethylacetylacetate

Zirconium butoxy trisethylacetoacetate

Zirconium butoxy bisethylacetoacetate

Zirconium tributoxy monoethylacetoacetate

Zirconium tetrakisethyllactate

Zirconium dibutoxy bisethyllactate

Bisacetylacetonate bisethylacetoacetate ziruconium

Monoacetylacetonate trisethylacetoacetate ziruconium

Zirconium chelate compounds such as Bisacetylacetonate bisethyllactate ziruconium, Zirconium alkoxides such as Zirconium n-butylate and zirconium n-propylate <Layer Thickness of a Base-Surface Modifying Layer>

A layer thickness of a base-surface modifying layer is preferably in a range of from 0.2 to 10 μm and more preferably in a range of from 0.2 to 3 μm.

<Content of an Aluminum Coupling Agent and of a Zirconium Coupling Agent>

A preferable content range of an aluminum coupling agent or a zirconium coupling agent in a base-surface modifying layer is from 1 to 100 weight % and more preferably is from 50 to 100 weight %.

Further following titanium coupling agents can be utilized in combination in a base-surface modifying layer according to the present invention. Concrete examples of the foregoing titanium coupling agent include such as isopropyl trisisostearoyl titanate, isopropyl tri(N-aminoethyl aminoethyl) titanate, diisopropyl bis(dioctylpyrophosphate) titanate, tetraisopropyl bis(dioctylphosphate) titanate, tetraoctyl bis (ditridecylphosphite) titanate, tetra(2,2-diallyloxymethyl-1-butyl) bis(ditridecyl) phosphite titanate, bis (dioctylpyrophosphate) oxyacetate titanate, bis (dioctylpyrophosphate) ethylene titanate, dibutoxytitane-bis (octyleneglycolate), dipropoxytitane-bis (ethylacetylacetate), dipropoxytitane-bis (triethanolaminato), tetrapropoxytitane and tetrabutoxy titane.

<A Releasing Layer>

A releasing layer according to the present invention will now be described.

A releasing layer of the present invention contains a silicone resin. Preferred as silicone resins according to the present invention are those which are known and exhibit a peel strength of at least 30 g/5 cm in order to obtain the effects of the present invention.

The silicone resins of the present invention are prepared employing hardenable silicones such as addition hardenable silicone, as well as condensation hardenable silicone, described below. Of these, silicone resins which are prepared employing condensation hardenable silicone, are more preferred.

Said addition hardenable silicone is prepared by allowing methylhydrogenpolysiloxane to react with straight chain methylvinylpolysiloxane having a vinyl group at both terminals or at both terminals, as well as in the chain, in the presence of platinum based catalysts.

Listed as specific examples of addition hardenable silicones are KS-887, KS-779H, KS-778, KS-835, X-62-2456, X-62-2494, X-62-2461, KS-3650, KS-3655, KS-3600, KS-847, KS-770, KS-770L, KS-776A, KS-856, KS-775, KS-830, KS-830E, KS-839, X-62-2404, X-62-2405, KS-3702, X-62-2232, KS-3503, KS-3502, KS-3703, and KS-5508, all manufactured by Shin-Etsu Silicone Co.

Listed as specific examples of condensation hardenable silicones, which are preferably employed, are KS-881, KS-882, KS-883, X-62-9490, and X-62-9028, all of which are also manufactured by Shin-Etsu Silicone Co. Of these, preferably employed are double release silicones for release paper such as KS-881, KS-882, KS-883, X-62-9490, and X-62-9028.

The surface contact angle of the releasing layer, according to the present invention, is preferable from 100 to 120 degrees, and is more preferably from 105 to 115 degrees. The surface contact angle, as described herein, refers to the contact angle of the surface of said releasing layer with respect to pure water. Said surface contact angle is determined employing, for example, an automatic contact angle meter AC-VZ (manufactured by Kyowa Kaimen Kagaku Co.) while utilizing a liquid drop method (approximately 15 μl of pure water is carefully dripped onto the surface t be measured and 0.5 second after contact, the contact angle is determined).

Surface roughness (which is defined below) of the releasing layer, according to the present invention, is preferably at most 0.2 μm, and is more preferably at most 0.1 μm.

The surface of the releasing layer of the present invention is required to have a specular surface, and preferably has a C value, which will be described below, of not less than 85, and more preferably not less than 90.

Thickness of the releasing layer, according to the present invention, is preferably from 1 to 50 μm, and is more preferably from 10 to 30 μm.

Further, a releasing layer according to a fixing belt or a fixing roller of the present invention is preferably adjusted to have a peel strength of not less than 30 g/5 cm, more preferably a range from 30 g/5 cm to 1,000 g/5 cm and specifically preferably from 50 g/5 cm to 600 g/5 cm.

Herein, peel strength of a releasing layer is measured according to the method described below.

<Method of Measuring Peel Strength of a Releasing Layer>

An adhesive tape (Nitto Polyester Tape No. 31B, manufactured by Nitto Denko Co., Ltd.) was adhered onto a releasing layer of a fixing belt in case of a fixing belt as shown in FIG. 9, or onto a releasing layer of a heat roller or of a pressure roller in case of a fixing roller such as shown in FIG. 10, and a press operation corresponding to one rotation of a pressure roller was performed while setting a pressure value of the pressure roller at 2 kg; thereafter, after a fixing belt or a fixing roller being kept standing at room temperature for 20 hours, a peel strength was measured by use of a tensile meter available on the market, under a condition of peeling the aforementioned adhesive tape at 180 degrees and at a speed of 0.3 m/min.

However, in case that both of a heat roller and a pressure roller are provided with a releasing layer, peel strength was measured with respect to the releasing layer on the side contacting with a recording material.

The hardness of the releasing layer of the present invention is requested to be not less than a durometer hardness of 90, which is measured using a method described in JIS K 6253. More preferably, the hardness is not less than 95. The hardness can be, measured using a method described below.

<Measuring Method for the Hardness of a Releasing Layer>

A fixing belt sample and a fixing roller sample each having a releasing layer on a base material were prepared. The sample was not stacked and measured using a type D durometer defined in JIS K 6253.

A fixing belt and a fixing roller of the present invention have a base-surface modifying layer and a releasing layer on a base material thereof, and are preferably provided with the adhesive layer described bellow in respect to preventing peeling-off of a releasing layer furthermore effectively.

<Adhesive Layer>

An adhesive layer utilized in the present invention will be explained

An adhesive layer utilized in the present invention preferably contains a compound having at least one reactive group selected from the group comprised of a hydroxy group, a carboxy group, a group represented by the foregoing general formula (a) and a group represented by the foregoing general formula (b), in respect to enhancing adhesion between a base material and a releasing layer.

Compounds Having a Reactive Group:

Compounds having a reactive group may be a low molecular weight compound or a polymer compound, and in the present invention, preferable compounds include such as a polyvinyl alcohol resin (e.g. PVA-124, 224 424, manufactured by Kuraray Co., Ltd.), a butyral resin (e.g. 3000K, manufactured by Denki Kagakukogyo Co.), a ethylene-vinyl acetate copolymer, an olefin type resin such as vinylidene chloride and polybutadiene, a urethane resin, a polyester resin, an acryl type resin, an epoxy type resin and polyethyleneimine type resin. Among them, preferably utilized is a butyral resin.

A content of the foregoing compound having a reactive group in an adhesive layer is preferably from 1 to 100 weight % and more preferable from 50 to 100 weight %. Further, in case that an adhesive layer utilized in the present invention is comprised of a resin (either one kind of resin or a mixture of plural resins) having a reactive group, a content of the repeating unit having the aforementioned reactive group in the total repeating unit comprising the resin is not more than 20% and more preferably from 1 to 20%.

Coupling Agents; Isocyanate Compounds:

An adhesive layer utilized in the present invention preferably contains at least one compound selected from the group comprising a silane coupling agent, a titanium coupling agent and an isocyanate compound, more preferably contains a titanium coupling agent or an isocyanate compound and specifically preferably contains a titanium coupling agent, in respect to exhibit adhesion enhancement effect furthermore preferably.

Titanium coupling agents include, for example, such as tetrabutyl titanate, tetraoctyl titanate, isopropyl triisostealoyl titanate, isopropyl tridecylbenzenesulfonyl titanate and bis (dioctyl pyrophosphate) oxyacetate titanate.

Further, listed are such as a monoalkoxy type, a chelate type having an oxyacetate residual group or an ethyleneglycol residual group and a coordinate type in which tetraalkyl titanate is addition reacted with a phosphite ester.

A monoalkoxy type includes such as isopropyl dimethacryl isostealoyl titanate, isopropyl tri(dioctyl phosphate) titanate, isopropyl tricumylphenyl titanate, isopropyl trioctanoyl titanate, isopropyl triisostealoyl titanate, isopropyl tridecyl benzenesulphonyl titanate, isopropyl tridodecyl benzenesulphonyl titanate and isopropyl tris(dictyl pyrophosphate) titanate.

Further, listed are such as titanium-i-propoxy octylene glycolate (TOG: manufactured by Nippon Soda Co., Ltd.), tetra-i-propoxy titane, tetra-n-butoxy titane, tetrakis(2-ethylhexoxy) titane, tetrastealoxy titane, di-i-propoxy.bis (acetylacetonato) titane, di-n-butoxy.bis(triethanolaminato) titane and dihydroxy titane.tri-i-stealate.

A chelate type includes such as bis(dioctylpyrophosphate) oxy acetate titanate, dicumylphenyloxy acetate titanate, dicumylphenyloxy acetate titanate and diisostealoylethylene titanate.

A coordinate type includes such as tetraisopropyl bis (ditridecylphosphite) titanate and tetraoctyl bis (ditridecylphosphite) titanate.

A silane coupling agent includes, for example, such as γ-(2-aminoethyl)aminopropyl trimethoxysilane, γ-(2-aminoethyl)aminopropyl methyldimethoxysilane, γ-mehtacryloxypropyl trimethoxysilane, N-β-(N-vinylbenzylaminoethyl) γ-aminopropyl trimethoxysilane hydrochloride, hexamethyldisilazane, methyltrimethoxysilane, butyltrimethoxyailane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, KBM503 (manufactured by Shinetsu Kagakukogyo Co., Ltd.) and p-methylphenyltrimethoxysilane.

An isocyanate compound includes, for example compounds represented by the following general formula.

General formula

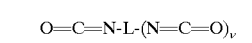

$$O{=}C{=}N\text{-}L\text{-}(N{=}C{=}O)_{\nu}$$

wherein, $_{\nu}$ represents 0, 1 or 2, and L represents a bivalent connecting group having an alkylene group, alkenylene group or allylene group as a partial structure.

These groups may be further provided with a substituent, and examples of preferable substituents include such as a halogen (for example, Br and Cl), a hydroxyl group, an amino group, a carboxyl group, an alkyl group and an alkoxyl group.

Specific examples of isocyanate compounds available from manufacturers are listed below, however the present invention is not limited thereto.

IC-1: Desmodur N100, manufactured by Mobey Co., aliphatic isocyanate

IC-2: Desmodur N3300, manufactured by Mobey Co., aliphatic isocyanate

IC-3: Mondur TD-80, manufactured by Mobey Co., aromatic isocyanate

IC-4: Mondur M, manufactured by Mobey Co., aromatic isocyanate

IC-5: Mondur MRS, manufactured by Mobey Co., polymer isocyanate

IC-6: Desmodur W, manufactured by Mobey Co., aliphatic isocyanate

IC-7: Papi 27, manufactured by Dow Co., polymer isocyanate

IC-8: Isocyanate T1980, manufactured by Huels Co., aliphatic isocyanate

IC-9: Octadecyl isocyanate, manufactured by Aldrich Co., aliphatic isocyanate

Further, listed are Colonate 2030, Colonate 2255, Colonate 2513, Colonate 2507, Colonate L, Colonate HL, Colonate HK, Colonate HX, Colonate 341, Colonate MX and Colonate 2067, which are manufactured by Nippon Polyurethane Co.; Takenate D103H, Takenate D204EA, Takenate D-172N and Takenate D-170N, which are manufactured by Takeda Yakuhin Kogyo; Sumidur N3200, Sumidur 44V-20 and Sumidur IL, which are manufactured by Sumitomo Bayer Urethane Co.

Further, in the present invention, an aluminum couplng agent such as acetoalkoxyaluminium diisopropylate also can be used.

A content of the foregoing coupling agent or isocyanate compound in an adhesive layer is preferably from 1 to 99 weight % and more preferably from 1 to 50 weight %.

<Layer Thickness of an Adhesive Layer>

Layer thickness of an adhesive layer utilized in the present invention is preferably adjusted to from 1 to 300 μm, more preferably from 1 to 100 μm and specifically preferably from 1 to 50 μm.

<Base Material>

A base material of a belt part material utilized for a fixing belt according to the present invention and each base material utilized for a heat roller and a pressure roller of a fixing roller according to the present invention will be explained.

A base material utilized for a belt part material is preferably seamless electro-formed nickel, and a base material for a heat roller and a pressure roller is preferably nickel. Further, thickness of a base material is preferably from 10 to 100 μm.

Further, employed as materials of said base material, other than nickel, may be aluminum, iron, and polyethylene.

The surface roughness of the base material of the fixing belt, as well as of the base material of the heating roller and the pressure roller according to the present invention is preferably less than or equal to 0.1 μm, and is more preferably less than or equal to 0.08 μm.

In order to achieve high glossiness, the surface of the base material is required to have a specular glossiness. The C value is preferably not less than 85, and more preferably not less than 90.

Further their Young's modulus is preferably more than or equal to 50 kN/mm$^2$, and is more preferably from 50 to 300 kN/mm$^2$.

<Surface Roughness>

Herein, the measurement method of the surface roughness of said releasing layer, as well as the surface roughness of said fixing belt and fixing roller, will now be described.

In the present invention, surface roughness Ra was determined based on the following method.

Employed as atomic force microscopy (AFM), was SPI3800 N Probe Station and SPA Multifunctional Type Unit, manufactured by Seiko Instruments Co. A test sample was cut to an approximate 1 cm square. The cut sample was placed on a horizontal sample stand and a cantilever was allowed to approach said sample surface. When said cantilever approached the region at which the atomic force takes effect, scanning was carried out in the XYZ directions. During said operation, unevenness of said sample was detected in the form of piezoelectric displacement in the Z direction. Employed as a piezoelectric scanner was one capable of scanning of XY 20 μm and Z 2 μm. Employed as said cantilever was silicon cantilever SI-DF20, manufactured by Seiko Instruments Co., having a resonance frequency of 120 to 150 kHz, and a spring constant of 12 to 20 N/m. Measurement was carried out under a DFM Mode (Dynamic Force Mode). The measurement region of a 2 μm square was measured employing 1 (or 2) visual field(s) and a scanning frequency of 1 Hz. Further, obtained data were subjected to least square approximation, and slight inclination of said sample was corrected and a standard plane was obtained.

Analysis of said surface roughness was carried out upon retrieving Surface Roughness Analysis from analysis software SPIwin (ver. 2 05D2, manufactured by Seiko Instruments Co.). Then, an average roughness was determined based on the obtained three-dimensional data.

The measured surface is expressed by Z=F(X,Y). The range of (X,Y) is from (0,0) to ($X_{max}$, $Y_{max}$). When the surface which is subjected to roughness analysis is designated as the specified surface*, surface area $S_0$ is obtained by the following formula.

$$S_0 = X_{max} \cdot Y_{max}$$

When the average of Z data within the specified surface is expressed by $Z_0$, $Z_0$ is expressed by the following formula, while taking a horizontal surface, satisfying $Z=Z_0$, as a standard surface.

$$Z_0 = \frac{1}{S_0} \int_0^{Y_{max}} \int_0^{X_{max}} F(X, Y)\, dX\, dY$$

In JIS B 601, center-line mean roughness (Ra) is expressed as follows. A portion of length L is extracted from the roughness curve in the center-line direction. When the center-line direction of said extracted portion is designated as the X axis, the longitudinal power direction is designated as the Y axis, and when the roughness curve is expressed by Y=F(X), Ra is defined as a value given by the following formula.

$$Ra = \frac{1}{L} \int_0^L |F(X)|\, dX$$

In the present invention, said center-line mean roughness Ra is three-dimensionally expanded so as to be applicable to the measured surface, and the value obtained from the resultant formula is defined as the surface roughness (hereinafter occasionally referred to as average roughness Ra) of the present invention. Further, said roughness is expressed as a value obtained by averaging the absolute values of deviation from the standard surface to the specified surface. The employed value is which is obtained using the following formula.

$$Ra = \frac{1}{S_0} \int_0^{Y_{max}} \int_0^{X_{max}} |F(X, Y) - Z_0|\, dX\, dY$$

<Production Method of a Fixing Belt and a Fixing Roller>

A production method of the fixing belt as well as the fixing roller according to the present invention will now be described.

The releasing layer according to the present invention may be coated in such a manner that after coating a sublayer or an adhesive layer in order to improve adhesiveness employing a dip coating system, a bar coating system, a blade coating system, an air-knife coating system, a slide coating apparatus, or a curtain coating system, said releasing layer is applied onto the resultant coating. It is preferable that the releasing layer according to the present invention applies said hardenable silicone such as a solvent addition type silicone or a solvent condensation type silicone onto the adhesive layer, employing a dip coating system.

Among them, preferable is to coat each of an adhesive layer and a releasing layer by means of a dip coating method. Viscosity of a coating solution in case of dip coating is preferably adjusted to a range of from 0.01 to 0.5 Pa/sec.

Further, in the present invention, the production method is preferably characterized by being comprised of a process for aging treatment A followed by a process for aging treatment B, after the foregoing releasing layer having been coated.

The aging treatment A has an effect to hydrolyze the base-surface modifying agent, and then the aging treatment B has an effect to condensate the hydrolyzed base-surface modifying agent.

Herein, aging treatment A represents, for example, that a fixing belt or a fixing roller, after being coated with a releasing layer, is immersed in water, sprayed with vapor and is kept for aging under heat and high humidity. Heat and high humidity represents that a temperature range of from 25 to 100° C., and a relative humidity of not lower than 50% RH and preferably from 50 to 95% RH.

Further, aging treatment B represents that a fixing belt or a fixing roller is treated under high temperature and low humidity after the foregoing aging treatment A; high temperature is preferably in a range of from 40 to 200° C. and more preferably in a rang of from 40 to 150° C., and low humidity represents a relative humidity of lower than 50% RH.

<Recording Materials>

Recording materials (also referred to as recording mediums) used in the present invention will now be described.

Said recording materials are not particularly limited as long as they are receptive to ink and can form images. However, from the viewpoint of strength, preferred are those comprising a support having thereon an ink receptive layer.

Employed as said supports may be those including paper supports such as plain paper, art paper, coated paper and cast-coated paper, plastic supports, paper supports coated with polyolefin on both sides, and composite supports prepared by laminating those above, which have been employed as common ink-jet recording materials.

For the purpose of increasing the adhesion force between the support and the ink absorptive layer, it is preferable that prior to coating said ink absorptive layer, said support is subjected to a corona discharge treatment or a subbing treatment. Further, the recording paper sheets of the present invention need not necessarily be white, but may be colored. Further, it is particularly preferred to employ paper supports prepared by laminating both sides of a base paper support with polyethylene so that recorded images approach conventional photographic quality and high quality images are obtained at low cost.

Such paper supports, which are laminated with polyethylene, will now be described.

Base paper employed for said paper support is produced employing wood pulp as a main raw material, and if desired, employing synthetic pulp such as polypropylene, or synthetic fiber such as nylon or polyester. As wood pulp, for example, any of LBKP, LBSP, NBKP, NBSP, LDP, NDP, LUKP, and NUKP may be employed. However, LBKP, NBSP, LBSP, NDP, and LDP having shorter fibers are preferably employed in a larger proportion. However, the content proportion of LBSP or LDP is preferably from 10 to 70 percent by weight.

As the above-mentioned pulp, chemical pulp (sulfate salt pulp and sulfite pulp) containing minimum impurities is preferably employed, and pulp, which has been subjected to bleaching treatment to increase whiteness, is also beneficial.

Suitably incorporated in said base paper may be, for example, sizing agents such as higher fatty acids and alkylketene dimers, white pigments such as calcium carbonate, talc, titanium dioxide, paper strength enhancing agents such as starch, polyacrylamide, and polyvinyl alcohol, optical brightening agents, moisture retaining agents such as polyethylene glycols, dispersing agents, and softeners such as quaternary ammonium salts.

The degree of water freeness of pulp employed for papermaking is preferably between 200 and 500 ml according to CSF specifications. Further, the sum of weight percent of 24-mesh residue and weight percent of 42-mesh calculated portion regarding the fiber length after beating, specified in JIS-P-8207, is preferably between 30 and 70 percent. Incidentally, the weight percent of 4-mesh residue is preferably less than or equal to 20 percent by weight.

The basis weight of said base paper is preferably from 30 to 250 g/m$^2$, and is more preferably from 50 to 200 g/m$^2$. The thickness of said base paper is preferably from 40 to 250 $\mu$m.

Said base paper may be provided with high smoothness through a calendering treatment during a paper making stage or after paper making. Density of said base paper is commonly from 0.7 to 1.2 g/cm$^3$ (based on JIS P 8118). Stiffness of said base paper is preferably from 20 to 200 g under conditions specified in JIS P 8143.

The surface of said base paper may be coated with surface sizing agents. Employed as said surface sizing agents may be sizing agents such as higher fatty acids and alkylketene dimers which may be incorporated in said base paper.

The pH of said base paper is preferably from 5 to 9, when determined employing the hot water extraction method specified in JIS P 8113.

Polyethylene employed for coating both sides of said base paper is comprised mainly of low density polyethylene (LDPE) and/or high density polyethylene (HDPE). In addition, LLDPE and polypropylene may be partially employed.

As widely employed in photographic paper, rutile or anatase type titanium oxide is preferably incorporated in polyethylene which is employed to prepare the polyethylene layer on the ink absorptive layer side so that the resultant opacity as well as whiteness is enhanced. The content proportion of said titanium oxide is commonly from 3 to 20 percent by weight, and is preferably from 4 to 13 percent by weight.

Polyethylene coated paper may be employed as glossy paper. Further, when polyethylene is applied onto the surface of said base paper through melt-extrusion, a matte surface or a silk surface, which is commonly available in photographic paper, may be prepared employing a so-called embossing process. In the present invention, such embossed polyethylene coated paper may also be employed.

The used amount of polyethylene on both sides of said base paper is determined so as to minimize curl at low humidity as well as at high humidity, after providing a porous layer and a backing layer. The thickness of the polyethylene layer on the porous layer side is commonly in the range of 20 to 40 $\mu$m, while the thickness on the backing layer side is commonly in the range of 10 to 30 $\mu$m.

Further, it is preferable that said polyethylene coated paper supports have the characteristics described below.

1. Tensile strength: tensile strength in the longitudinal direction is preferably from 2 to 30 kg, and the same in the lateral direction is preferably from 1 to 20 kg in terms of the tensile strength specified in JIS P 8113.
2. Tear strength: tear strength in the longitudinal direction is preferably from 10 to 200 g, and the same in the lateral direction is preferably from 20 to 200 g when determined employing the method specified in JIS P 8116.
3. Compressive elasticity modulus $\geqq$98.1 MPa
4. Surface Beck smoothness: glossy surface preferably results in at least 20 seconds under conditions specified in JIS P 8119. However, a so-called embossed surface may be less or equal to said value.

5. Surface roughness: the average surface roughness, specified in JIS B 0601, preferably exhibits a maximum height, per the standard length of 1.5 mm, of at most 10 $\mu$m.
6. Opacity: opacity is preferably at least 80 percent and is more preferably from 85 to 98 percent, when determined employing the method specified in JIS P 8183.
7. Whiteness: L*, a*, and b*, specified in JIS Z 8729 are preferably from 80 to 95, from −3 to +5, and from −6 to +2, respectively.
8. Surface glossiness: 60-degree specular glossiness specified in JIS Z 8741 is preferably from 10 to 95 percent.
9. Clark stiffness: supports having a Clark stiffness of recording paper sheets in the transport direction of 50 to 300 $cm^2/100$ is preferred.
10. Moisture content in core paper: moisture content of core paper is commonly from 2 to 100 percent by weight with respect to the core paper, and is preferably from 2 to 6 percent by weight.

The ink absorptive layer of recording materials is mainly divided into a swelling type and a porous type.

In said swelling type, hydrophilic binders, such as gelatin, polyvinyl alcohol, polyvinylpyrrolidone, and polyethylene oxide, are coated individually or in combination so as to be usable as an ink absorptive layer.

In said porous type, minute particles and hydrophilic binders are blended and coated. Those which result in gloss are preferred. Preferred as minute particles are alumina and silica. Particularly preferred are those employing silica of a particle diameter of less than or equal to 0.1 $\mu$m. Preferred as hydrophilic binders are binders such as gelatin, polyvinyl alcohol, polyvinylpyrrolidone, and polyethylene oxide which may be employed individually or in combination.

In order to achieve continuous or high speed printing, recording materials which result in a high ink absorbing rate are more preferred. From said view point, porous type recording materials are more preferable employed.

The porous type ink absorptive layer of the recording material, employed in the present invention, will now be described.

A porous layer is formed mainly utilizing the soft coalescence of hydrophilic binders and fine inorganic particles. Heretofore, various methods have been known which form pores in a layer. For example, such methods include a method in which a uniform coating composition, comprising at least two types of polymers, is applied onto a support and during the drying process, these polymers are subjected to phase separation from one another so as to form pores, a method in which a coating composition, comprising fine solid particles and hydrophilic or hydrophobic binders, is applied onto a support, and after drying, pores are formed by immersing the resultant ink-jet recording sheet in a composition containing water, or suitable organic solvents, so as to form pores by dissolving fine solid particles, a method in which after coating a coating composition, comprising compounds which generate gas during layer formation, pores are formed by allowing said compounds to generate gas during a drying process, a method in which a coating composition, comprising fine porous solid particles and hydrophilic binders, is applied onto a support, and pores are formed in said fine porous solid particles or between said fine particles, and a method in which a coating composition, comprising fine solid particles or fine oil droplets having approximately the same or a larger volume than hydrophilic binders and hydrophilic binders is applied onto a support and pores are formed between said fine solid particles. In the present invention, it is particularly preferred that pores are formed by incorporating various types of fine inorganic solid particles in the porous layer, having an average diameter of less than or equal to 100 $\mu$m.

Listed as fine inorganic particles employed to achieve said purposes may be white inorganic pigments such as precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo boehmite, aluminum hydroxide, lithopone, zeolite, and magnesium hydroxide.

The average diameter of fine inorganic particles is obtained as follows. Particle themselves or particles which appear in the cross-section or on the surface of a porous layer are observed employing an electron microscope, and the diameter of each of 1,000 randomly selected particles is determined. Subsequently, an arithmetic average (or number average) is obtained based on the measured data. Herein, the diameter of each particle is expressed as a diameter of a circle having the same projected area as said particle.

Preferably employed as fine solid particles are those selected from alumina or alumina hydrate, and silica is more preferred.

Preferably employed as said silica are silica synthesized employing a conventional wet method, colloidal silica, and silica synthesized employing a gas phase method. In the present invention, listed as the most preferably employed fine particle silica is colloidal silica or fine particle silica synthesized employing a gas phase method. Of these, fine particle silica, synthesized employing a gas phase method, is more preferred, since it enables obtaining a high void ratio and in addition, when cationic polymers for fixing dyes are added, coarse coalescences tend not to form. Further, alumina or alumina hydrate may be crystalline or non-crystalline, and it is possible to employ particles having other optional shapes such as irregular-shaped particles, spherical particles, and needle-shaped particles.

It is preferable that fine particles in a fine particle dispersion prior to mixing with cationic polymers is dispersed to the state of primary particles.

The diameter of said fine inorganic particles is preferably less than or equal to 100 nm. For example, in the case of said gas phase method produced fine particle silica, the average diameter (the particle diameter in the dispersed state prior to coating) of said primary particles, which have been dispersed, is preferably less than or equal to 100 nm, is more preferably from 4 to 50 nm, and is most preferably from 4 to 20 nm.

The most preferably employed silica, having a primary particle diameter of 4 to 20 nm, which are synthesized employing a gas phase method, is commercially available as, for example, Aerosil of Nippon Aerosil Co. It is possible to relatively easily disperse said gas phase method produced fine particle silica up to primary particles through suction dispersion, employing, for example, Jet Stream Inductor Mixer, manufactured by Mitamura Riken Kogyo Co., Ltd.

Listed as hydrophilic binders are, for example, polyvinyl alcohol, gelatin, polyethylene oxide, polyvinylpyrrolidone, polyacrylic acid, polyacrylamide, polyurethane, dextran, dextrin, Kalageenan (κ, ι, λ), agar, Pullulan, water-soluble polyvinyl butyral, hydroxyethyl cellulose, and carboxymethyl cellulose. These water-soluble resins may be employed in combinations of at least two types.

The water-soluble resins, which are preferably employed in the present invention, are polyvinyl alcohols. Polyvinyl alcohols, which are preferably employed in the present invention, include modified polyvinyl alcohol such as polyvinyl alcohol of which terminals are subjected to cationic modification, anion modified polyvinyl alcohol having an anionic group, other than common polyvinyl alcohol which is prepared by hydrolyzing polyvinyl acetate.

Of polyvinyl alcohols which are prepared by hydrolyzing vinyl acetate, those having an average degree of polymerization of at least 1,000 are preferably employed, and those having an average degree of polymerization of 1,500 to 5,000 are more preferably employed. It is preferable that the degree of saponification is 70 to 10%. It is more preferable that the degree of saponification is 80 to 99.5%.

Said cation modified polyvinyl alcohol refers to one which has a primary, secondary or tertiary amino group or a quaternary ammonium group in the main chain or the side chain, as described in, for example, Japanese Patent Publication Open to Public Inspection No. 61-10483, and is prepared by hydrolyzing a copolymer of ethylenic unsaturated monomer having a cationic group with vinyl acetate.

Listed as ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-vinyl-2-methylimidazole, N-(2-dimethylaminopropyl)methacrylamide, hydroxyethyltrimethylammonium chloride, trimethyl-(2-methacrylamidopropyl)ammonium chloride, and N-(1,1-dimethyl-3-dimethylaminopropyl)acrylamide.

The ratio of the cation modified group containing monomers of cation modified polyvinyl alcohol is typically from 0.1 to 10.0 mol percent with respect to vinyl acetate, and is preferably from 0.2 to 5.0 mol percent.

Listed as anion modified polyvinyl alcohols are polyvinyl alcohol having an anionic group, as described in, for example Japanese Patent Publication Open to Public Inspection No. 1-206088, copolymers of vinyl alcohol with vinyl compounds having a water-soluble group, as described in Japanese Patent Publication Open to Public Inspection Nos. 61-237681 and 63-3079799, and modified polyvinyl alcohol having a water soluble group, as described in Japanese Patent Publication Open to Public Inspection No. 7-285265.

Further, listed as nonion modified polyvinyl alcohol are polyvinyl alcohol derivatives which are prepared by adding a polyalkylene oxide group to a part of polyvinyl alcohol, as described in, for example, Japanese Patent Publication Open to Public Inspection No. 7-9758, and block copolymers of vinyl compounds having a hydrophobic group with vinyl alcohol, as described in, for example, Japanese Patent Publication Open to Public Inspection No. 8-25795.

Polyvinyl alcohols, which differ in their degree of polymerization and their type of modification, may be employed in combination of at least two types.

The added amount of fine inorganic particles, employed in a colorant receptive layer, varies widely depending on the desired ink absorption capacity, the void ratio of the porous layer, the types of fine inorganic particles, and the types of water-soluble resins. However, said added amount is commonly from 5 to 30 g per $m^2$ of the recording sheet, and is preferably from 10 to 25 g.

Further, the ratio of fine inorganic particles to water-soluble resins, employed in said colorant receptive layer, is commonly from 2:1 to 20:1 in terms of weight ratio, and is preferably from 3:1 to 10:1.

Said colorant receptive layer may comprise water-soluble cationic polymers, having a quaternary ammonium salt group in the molecule. They are commonly employed in an amount of 0.1 to 10.0 g per $m^2$ of the ink-jet recording sheet, and are preferably employed in an amount of 0.2 to 5.0 g.

In the porous layer, the total void amount (being a void volume) is preferably at least 20 ml per $m^2$ of the recording sheet. When said void volume is less than 20 ml/$m^2$, in the case of a small ink amount, said porous layer exhibits the desired ink absorbability. However, when the ink amount increases, ink is not completely absorbed, and problems tend to occur such that image quality is degraded and the drying rate is lowered.

In the porous layer capable of bearing ink, the void volume with respect to the solid volume is called a void ratio. In the present invention, it is preferable to adjust said void ratio to at least 50 percent so that it is possible to effectively form pores without resulting in an unnecessary increase in the layer thickness.

Besides forming the ink solvent absorptive layer employing fine inorganic particles, as another porous type, an ink solvent absorptive layer may be formed employing a coating composition in which a polyurethane resin emulsion is employed together with water-soluble epoxy compounds and/or acetoacetylated polyvinyl alcohol and further together with epichlorohydrin polyamide resins. In such a case, it is preferable that said polyurethane resin emulsion is comprised of particles of a diameter of 3.0 $\mu$m of the polyurethane resin having a polycarbonate chain, as well as said polycarbonate chain and a polyester chain. Further, it is preferable that said polyurethane resin in said polyurethane resin emulsion is prepared by reacting polycarbonate polyol, or polyol having polycarbonate polyol and polyester polyol with aliphatic isocyanate compounds and the resultant polyurethane resin has a sulfonic group in the molecule. It is more preferable that epichlorohydrin polyamide resin, and water-soluble epoxy compounds and/or acetoacetylated polyvinyl alcohol are included.

It is assumed that in the ink solvent absorptive layer employing said polyurethane resin, weak coalescence between cations and anions is formed, and as a result, pores capable of absorbing ink solvents are formed, whereby it is possible to form images.

In the present invention, in order to achieve objectives of the present invention, it is preferable that a layer, comprising thermoplastic resins, is provided on the surface layer of the ink absorptive layer.

The layer, comprising thermoplastic resins may comprise only thermoplastic resins or, if desired, may further comprise water-soluble binders. From the viewpoint of ink penetrability, said thermoplastic resins are preferably in the form of minute particles.

Listed as thermoplastic resins and those in the form of minute particles are, for example, polycarbonate, polyacrylonitrile, polystyrene, polyacrylic acid, methacrylic acid, polyvinyl chloride, polyvinyl acetate, polyester, polyether, and copolymers and salts thereof. Of these, preferred are styrene-acrylic acid ester copolymers, vinyl chloride-vinyl acetate copolymers, vinyl chloride-acrylic acid ester copolymers, ethylene-vinyl acetate copolymers, ethylene-acrylic acid ester copolymers, and SBR latex. Said thermoplastic resins or those in the form of minute particles may be employed in combinations of a plurality of polymers which are different in their monomer composition, particle diameter, and degree of polymerization.

When thermoplastic resins or those in the form of minute particles are selected, it is necessary to take into account ink receptive properties, glossiness of images after heating and pressure fixing, image durability, and releasing properties.

With regard to said ink receptive properties, when the diameter of fine thermoplastic particles is less than 0.05 $\mu$m, the separation rate of ink solvents from pigment particles in pigment ink is decreased, resulting in decreasing the ink absorption rate. On the other hand, it is not preferable that said diameter exceeds 10 μm, from the viewpoint of adhesion between the ink absorptive layer and the adjacent solvent absorptive layer when applied onto a support, as well as the layer strength of ink-jet recording material after coating and drying. As a result, the diameter of fine thermoplastic resin particles is preferably from 0.05 to 10.00 μm, is more preferably from 0.1 to 5.0 μm, and is still more preferably from 0.1 to 1.0 μm.

Further, listed as criteria to select thermoplastic resins and those in the form of fine particles is the glass transition point (Tg). When Tg is lower than the coating drying temperature, for example when the coating drying temperature during production of a recording material has been higher than Tg and pores formed by fine thermoplastic particles, through which ink solvents pass, disappear.

Further, when Tg is higher than the temperature at which a support is modified due to heat, a fixing operation at high temperature is required to carry out melted layer forming. As a result, problems occur with regard to load applied to the apparatus as well as the thermal stability of the support. The Tg of said fine thermoplastic particles is preferably from 50 to 150° C. Further, minimum film forming temperature (MTF) of said particles is preferably from 50 to 150° C.

From the viewpoint of environmental protection, it is preferable that said fine thermoplastic particles are dispersed into a water based medium. Water based latex, which is prepared by emulsion polymerization, is specifically preferred. In such a case, preferably employed may be a type of latex which is prepared by emulsion polymerization, employing nonionic dispersing agents as an emulsifier.

Further, from the viewpoint of avoiding unpleasant odor as well as safety, it is preferable that residual monomer components are minimized. Specifically, the ratio of said residual monomer components is preferably at most 3 percent with respect to the solid weight of polymers, is more preferably at most 1 percent, and is most preferably at most 0.1 percent.

Employed as water-soluble binders may be polyvinyl alcohol and polyvinylpyrrolidone in an amount of 1 to 10 percent of said fine thermoplastic particles.

Preferably employed as recording materials according to the present invention may be those which comprise a support having thereon an ink absorptive layer as well as a surface layer comprising at least inorganic pigment and fine thermoplastic particles.

Listed as particularly preferable reasons are the following points.

(a) Said materials result in a high ink absorption rate, cause minimal image degradation such as beading as well as color bleeding, and have high speed printing adaptability.
(b) The image surface exhibits high strength.
(c) When printed sheets are stored upon being stacked, minimal melt adhesion occurs.
(d) Said materials exhibit desired coating productivity of the ink absorptive layer.
(e) Said materials exhibit desired writability.

In this case, it is preferable that the solid weight ratio of fine thermoplastic particles to inorganic pigments in the surface layer is individually determined depending on employed fine thermoplastic particles, inorganic pigments, and other additives. Said ratio is not particularly limited. However, selection is preferably carried out in a range so that the fine thermoplastic particles/inorganic pigments ratio is from 2/8 to 8/2, is more preferably carried out in the range so that the same is from 3/7 to 7/3, and is still more preferably carried out in the range so that the same is from 4/6 to 6/4.

<Colorant>

Colorants employed in the present invention will now be described.

Employed as colorants usable in the present invention may be any of those known in the prior art without any particular limitation. It is possible to employ any of the water-soluble dyes, water-dispersible dyes, water-dispersible pigments, solvent-soluble dyes, solvent-dispersible dyes, and solvent-dispersible pigments. Of these, preferably employed are solvent-dispersible pigments.

These may be employed individually or in combinations of a plurality of types. Of these, particularly preferred colorants are in the form of dispersed particles of dispersible dyes or dispersible pigments. In the following, listed are representative colorants. However, the present invention is not limited to these.

<Direct Dyes>

C.I. Direct Yellow 1, 4, 8, 11, 12, 24, 26, 27, 28, 33, 39, 44, 50, 58, 85, 86, 100, 110, 120, 132, 142, and 144;

C.I. Direct Red 1, 2, 4, 9, 11, 13, 17, 20, 23, 24, 28, 31, 33, 37, 39, 44, 47, 48, 51, 62, 63, 75, 79, 80, 81, 83, 89, 90, 94, 95, 99, 220, 224, 227, and 243;

C.I. Direct Blue 1, 2, 6, 8, 15, 22, 25, 71, 76, 78, 80, 86, 87, 90, 98, 106, 108, 120, 123, 163, 165, 192, 193, 194, 195, 196, 199, 200, 201, 202, 203, 207, 236, and 237;

C.I. Direct Black 2, 3, 7, 17, 19, 22, 32, 38, 51, 56, 62, 71, 74, 75, 77, 105, 108, 112, 117, and 154.

<Acid Dyes>

C.I. Acid Yellow 2, 3, 7, 17, 19, 23, 25, 29, 38, 42, 49, 59, 61, 72, and 99;

C.I. Acid Orange 56 and 64;

C.I. Acid Red 1, 8, 14, 18, 26, 32, 37, 42, 52, 57, 72, 74, 80, 87, 115, 119, 131, 133, 134, 143, 154, 186, 249, 254, and 256;

C.I. Acid Violet 11, 34, and 75;

C.I. Acid Blue 1, 7, 9, 29, 87, 126, 138, 171, 175, 183, 234, 236, and 249;

C.I. Acid Green 9, 12, 19, 27, and 41;

C.I. Acid Black 1, 2, 7, 24, 26, 48, 52, 58, 60, 94, 107, 109, 110, 119, 131, and 155.

<Reactive Dyes>

C.I. Reactive Yellow 1, 2, 3, 13, 14, 15, 17, 37, 42, 76, 95, 168, and 175;

C.I. Reactive Red 2, 6, 11, 21, 22, 23, 24, 33, 45, 111, 112, 114, 180, 218, 226, 228, and 235;

C.I. Reactive Blue 7, 14, 15, 18, 19, 21, 25, 38, 49, 72, 77, 176, 203, 220, 230, and 235;

C.I. Reactive Orange 5, 12, 13, 35, and 95;

C.I. Reactive Brown 7, 11, 33, 37, and 46;

C.I. Reactive Green 8 and 19;

C.I. Reactive Violet 2, 4, 6, 8, 21, 22, and 25;

C.I. Reactive Black 5, 8, 31, and 39.

<Basic Dyes>

C.I. Basic Yellow 11, 14, 21, and 32;

C.I. Basic Red 1, 2, 9, 12, and 13;

C.I. Basic Violet 3, 7, and 14;

C.I. Basic Blue 3, 9, 24, and 25.

In addition, listed as ink dyes employed in the present invention may be chelate dyes and azo dyes employed in so-called silver dye bleach method light-sensitive materials (for example, Cibachrome manufactured by Ciba-Geigy).

For example, British Patent No. 1,077,484 may be used as a reference with regard to chelate dyes.

For example, British Patent Nos. 1,039,458, 1,004,957, and 1,077, and U.S. Pat. No. 628, 2,612,448 may be used as a reference with regard to silver dye bleach light-sensitive material azo dyes.

The content ratio of water-soluble dyes employed in the ink of the present invention is preferably from 1 to 15 percent by weight with respect to the total weight of the ink.

Listed as disperse dyes, which are preferably employed in the present invention, are, for example:

C.I. Disperse Yellow 3, 4, 5, 7, 9, 13, 24, 30, 33, 34, 42, 44, 49, 50, 51, 54, 56, 58, 60, 63, 64, 66, 68, 71, 74, 76, 79, 82, 83, 85, 86, 88, 90, 91, 93, 98, 99, 100, 104, 114, 116, 118, 119, 122, 124, 126, 135, 140, 141, 149, 160, 162, 163, 164, 165, 179, 180, 182, 183, 186, 192, 198, 199, 202, 204, 210, 211, 215, 216, 218, and 224;

C.I. Disperse Orange 1, 3, 5, 7, 11, 13, 17, 20, 21, 25, 29, 30, 31, 32, 33, 37, 38, 42, 43, 44, 45, 47, 48, 49, 50, 53, 54, 55, 56, 57, 58, 59, 61, 66, 71, 73, 76, 78, 80, 89, 90, 91, 93, 96, 97, 119, 127, 130, 139, and 142;

C.I. Disperse Red 1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 277, 278, 279, 281, 288, 298, 302, 303, 310, 311, 312, 320, 324, and 328;

C.I. Disperse Violet 1, 4, 8, 23, 26, 27, 28, 31, 33, 35, 36, 38, 40, 43, 46, 48, 50, 51, 52, 56, 57, 59, 61, 63, 69, and 77;

C.I. Disperse Green 9;

C.I. Disperse Brown 1, 2, 4, 9, 13, and 19;

C.I. Disperse Blue 3, 7, 9, 14, 16, 19, 20, 26, 27, 35, 43, 44, 54, 55, 56, 58, 60, 62, 64, 71, 72, 73, 75, 79, 81, 82, 83, 87, 91, 93, 94, 95, 96, 102, 106, 108, 112, 113, 115, 118, 120, 122, 125, 128, 130, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 267, 268, 270, 284, 285, 287, 288, 291, 293, 295, 297, 301, 315, 330, and 333; and C.I. Disperse Black 1, 3, 10, and 24.

From the viewpoint for obtaining desired glossiness, preferably employed as colorants used in the present invention are pigments. Further, preferably employed as pigments used in pigment ink may be insoluble pigments, organic pigments such as lake pigments and carbon black.

Insoluble pigments are not particularly limited. Preferred are, for example, azo, azomethine, methine, triphenylmethane, triphenylmethane, quinacridone, anthraquinone, perylene, indigo, quinophtharone, isoindolinone, isoindoline, azine, oxazine, thiazine, dioxazine, thiazole, phthalocyanine, and diketopyrolopyrrole.

Listed as specific pigments which are preferably employed are those in the following.

Listed as pigments for magenta or red are, for example, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48: 1; C.I. Pigment Red 53: 1, C.I. Pigment Red 57: 1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Listed as pigments for orange or yellow are, for example, C.I. Pigment Orange 31, C.I. Pigment Orange 43, C.I. Pigment Yellow 12, C.I. Pigment Yellow 13, C.I. Pigment Yellow 15, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, and C.I. Pigment Yellow 138.

Listed as pigments for green or cyan are, for example, C.I. Pigment Blue 15, C.I. Pigment Blue 15: 2, C.I. Pigment Blue 15: 3, C.I. Pigment Blue 16, C.I. Pigment Blue 60, and C.I. Pigment Green 7.

Other than these, listed are, for example, carbon black pigments (C.I. Pigment Black 7); C.I. Pigment Yellow 12, 13, 14, 16, 17, 73, 74, 75, 83, 108, 109, 110, 180, 182; C.I. Pigment Red 5, 7, 12, 112, 123, 168, 184, and 202; C.I. Pigment Blue 1, 2, 3, 15: 3, 16, 22, and 60; and C.I. Vat Blue 4 and 60.

When other than these pigments, red, green, blue, and intermediate colors are needed, the pigments shown below are employed individually or in combination.

For example, employed are

C.I. Pigment Red 209, 224, 177, and 194;

C.I. Pigment Orange 43;

C.I. Vat Violet 3;

C.I. Pigment Violet 19, 23, and 37;

C.I. Pigment Green 36 and 7; and

C.I. Pigment Blue 15: 6.

It is preferable that pigments as well as disperse dyes employed in the present invention are dispersed together with dispersing agents and additives necessary for achieving desired purposes, employing a homogenizer and subsequently employed. Employed as homogenizers may be ball mills, sand mills, line mills, and high pressure homogenizers which are known in the prior art.

Employed as said dispersing agents are surface active agents. Employed as surface active agents used in the present invention may be any of the cationic, anionic, amphoteric, or nonionic ones. Listed as cationic surface active agents are aliphatic amine salts, aliphatic quaternary ammonium salts, benzalkonium salts, benzethonium chloride, pyridinium salts, and imidazolinium salts. Listed as anionic surface active agents are fatty acid soap, N-acyl-N-methylglycine salts, N-acyl-N-methyl-β-alanine salts, N-acylglutamic acid salts, acylated peptides, alkyl sulfonate, alkylbenzenesulfonates, alkylnaphthalenesulfonates, dialkyl sulfosuccinates, alkyl sulfoacetates, α-olefinsulfonates, N-acylmethyltaurine, sulfonated oil, higher alcohol sulfonates, secondary higher alcohol sulfonates, alkyl ether sulfonates, secondary higher alcohol ethoxysulfates, polyoxyethylene alkyl phenyl ether sulfates, monoglysulfates, fatty acid alkylolamidosulfates, alkyl ether phosphates, and alkyl phosphates. Listed as amphoteric surface active agents are carboxybetaine types, sulfobetaine types, aminocarboxylates, and imidazolium betaine. Listed as nonionic surface active agents are polyoxyethylene secondary alcohol ether, polyoxyethylene alkyl phenyl ether, polyoxyethylene sterol ether, polyoxyethylene lanoline derivative polyoxyethylene polyoxypropylene alkyl ether, polyoxyethylene glycerin fatty acid esters, polyoxyethylene castor oil, hardened castor oil, polyoxyethylene sorbitol fatty acid esters, polyethylene glycol fatty acid esters, fatty acid monoglycerides, monoglycerin fatty said esters, sorbitan fatty acid esters, propylene glycol fatty acid esters, sugar fatty acid esters, fatty acid alkanolamide, polyoxyethylene fatty acid amides, polyoxyethylene alkylamine, alkylamine oxides, acetylene glycol, and acetylene alcohol.

Further, for example, when said colorants are employed as ink for ink-jet recording, in order to accelerate penetration of ink droplets into a medium after ink ejection, it is preferable to use surface active agents. Such surface active agents are not particularly limited as long as the storage stability of ink comprising said surface active agents is not adversely affected, and surface active agents analogous to those employed as said dispersing agents are employed.

In the present invention, it is possible to use electric conductivity controlling agents. Said electric conductivity controlling agents include, for example, inorganic salts such as potassium chloride, ammonium chloride, sodium sulfate, sodium nitrate, and sodium chloride, and water-soluble amines such as triethanolamine.

Viscosity modifiers, resistivity controlling agents, layer forming agents, UV absorbers, antioxidants, anti-discoloring agents, rust inhibitors, and antiseptic agents may also be incorporated in the ink employed in the present invention, depending on the purposes to improve the ejection stability, the adaptability of printing heads and ink cartridges, the storage stability, and the image retention properties.

The ink employed in the present invention is comprised of water and water-soluble organic solvents as major liquid medium components. Listed as water-soluble organic solvents are alkyl alcohols having from 1 to 4 carbon atoms (for example, methyl alcohol, ethyl alcohol, n-propyl alcohol, isopropyl alcohol, n-butyl alcohol, sec-butyl alcohol, tert-butyl alcohol, and isobutyl alcohol), amides (for example, dimethylformamide, and dimethylacetamide), ketone or keto alcohols (for example, acetone diacetone alcohol), ethers (for example, tetrahydrofuran, and dioxane), polyalkylene glycols (for example, polyethylene glycol and polypropylene glycol), alkylene glycols in which an alkylene group has from 2 to 6 carbon atoms (for example, ethylene glycol, propylene glycol, butylenes glycol, triethylene glycol, 1,2,6-hexanetriol, thiodiglycol, hexylene glycol, and diethylene glycol), glycerin, lower alkyl ethers of polyhydric alcohols (such as ethylene glycol methyl ether, diethylene glycol methyl (or ethyl) ether, and triethylene glycol monomethyl (or ethyl) ether).

Of a number of said water-soluble organic solvents, preferred are polyhydric alcohols such diethylene glycol and lower alkyl ethers of polyhydric alcohols such as triethylene glycol monomethyl (or ethyl) ether.

The proportion of said water-soluble organic solvents is commonly from 10 to 70 percent by weight with respect to the total weight of the ink, is more preferably from 30 to 65 percent by weight, and is most preferably from 40 to 60 percent.

For the purpose of enhancing ink adhesion into an image transferring medium and image durability on said image transferring medium, it is preferable that thermoplastic resinous particles be incorporated in the ink for ink-jet recording which is employed in the present invention. Further, it is particularly preferable that dispersed particles of colorants are subjected to resin coating. Said thermoplastic resinous particles may be combined with any of the dissolved dye systems, the dispersed dye systems, or the dispersed pigment systems. Further, said resin coating may most suitably apply to the dispersion dye systems and dispersion pigment systems. In order to stabilize liquid physical properties at room temperature, the melting point of said thermoplastic resins is preferably at least 30° C., and is more preferably at least 40° C. Listed as said thermoplastic resins may be those which are employed in the transfer layer described below. Without any particular limitation, employed as coating agents of particles employing in said resin coating may be thermoplastic resins, which are known in the prior art, having a melting point of at least 50° C. The melting point of said resins is more preferably at least 50° C. Listed as thermoplastic resins may be, for example, acrylate based resins, methacrylate based resins, styrene based resins, styrene-acryl copolymers, styrene-butadiene copolymers, acrylonitrile-butadiene copolymers, polybutadine, vinyl acetate, polyvinyl chloride, polyvinylidene chloride, ethylene-vinyl acetate copolymers, homopolymers or copolymer resinous emulsions having hydrophilic functional groups such olefin based or an amino group, an amido group, a carboxyl group, and a hydroxyl group, microemulsions, natural or synthetic wax emulsions of fine organic particles having three-dimensional crosslinking in their interior, paraffin wax, polyethylene wax, carnauba wax, latexes, colloid compositions, and suspensions.

Employed as ink, used to form images, may be water based ink compositions, oil based ink compositions, and solid (phase change) ink compositions of these, water based ink compositions (for example, water based recording liquid for ink-jet recording which comprises water in an amount of at least 10 percent by weight of the total ink weight) is most preferably employed.

If desired, pigment dispersing agents may be employed for said pigments. Listed as usable pigment dispersing agents are, for example, surface active agents such as higher fatty acid salts, alkyl sulfates, alkyl sulfonates, sulfosuccinates, naphthalenesulfonates, alkyl phosphates, polyoxyalkylene alkyl ether phosphates, polyoxyalkylene alkyl phenyl ether, polyoxyethylene polyoxypropylene glycol, glycerin ester, sorbitan ester, polyoxyethylene fatty acid amide, and amine oxide, or block copolymers and random copolymers comprised of at least two types of monomers selected from the group consisting of styrene, styrene derivatives, vinylnaphthalene derivatives, acrylic acid, acrylic acid derivatives, maleic acid, maleic acid derivatives, itaconic acid, itaconic acid derivatives, fumaric acid, and fumaric acid derivatives, and salts thereof.

Methods for dispersing said pigments are not particularly limited. Employed as said methods may be, for example, various methods employing, for example, a ball mill, a sand mill, an attriter, a roll mill, an agitator, a Henschel mixer, a colloid mill, an ultrasonic homogenizer, a pearl mill, a wet type jet mill, and a paint shaker.

For the purpose of removing any coarse particle portion in the pigment dispersion, according to the present invention, employing a centrifuge, as well as employing filters, is also a preferable method.

The average diameter of pigment particles in the pigment ink is determined while taking into account the stability in said ink, the image density, the gloss, and the lightfastness. In the method for forming ink-jet pigment images of the present invention, it is further preferable that said particle diameter is determined while taking into account the enhancement of gloss as well as image quality. In the present invention, reasons of enhancing the gloss as well as image quality have not been yet clarified. However, it is assumed that said enhancement relates to the fact that pigments in images are dispersed into the layer which is formed by melting fine thermoplastic particles. When a high speed process is aimed, it is desired that in a short time, fine thermoplastic particles are melted so as to form a layer, and further, pigments are sufficiently dispersed into the resultant layer. During this process, the surface area of pigment particles plays an important role, and therefore there is an optimal range of the average particle diameter.

When a water based ink composition, which is the preferable form as a pigment ink, is prepared, it is preferable to use water-soluble organic solvents as a component.

Listed as water-soluble organic solvents are, for example, alcohols (for example, methanol, ethanol, propanol, isopropanol, butanol, isobutanol, secondary butanol, tertiary butanol, pentanol, hexanol, cyclohexanol, and benzyl alcohol); polyhydric alcohols (for example, ethylene glycol, diethylene glycol, triethylene glycol, polyethylene glycol, propylene glycol, dipropylene glycol, polypropylene glycol, butylene glycol, hexanediol, pentanediol, glycerin, hexanetriol, and thiodiglycol); polyhydric alcohol ethers (for example, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, ethylene glycol monophenyl ether, and propylene glycol monophenyl ether); amines (for example, ethanolamine, diethanolamine, triethanolamine, N-methyldiethanolamine, N-ethyldiethanolamine, morpholine, N-ethylmorpholine, ethylenediamine, diethylenediamine, triethylenetetraamine, tetraethylenepentaamine, polyethyleneimine, pentamethyldiethylenetriamine, and tetramethylpropylenediamine); amides (for example formamide, N,N-dimethylformamide, and N,N-dimethylacetamide); heterocyclic rings (for example, 2-pyrrolidone, N-methyl-2-pyrrolidone, cyclohexylpyrrolidone, 2-oxazolidone, and 1,3-dimethyl-2-imidazolidinone); sulfoxides (for example, dimethylsulfoxide); sulfones (for example, sulfolane); urea; acetonitrile; and acetone. Listed as preferred water-soluble organic solvents are polyhydric alcohols. Further, it is particularly preferred that polyhydric alcohol is employed together with polyhydric alcohol ether.

Said water-soluble organic solvents may be employed individually or in combinations of a plurality of those. The added amount of said water-soluble solvents in ink is typically from 5 to 60 percent by weight in total, and is preferably from 10 to 35 percent by weight.

Fine thermoplastic particles, viscosity modifiers, surface tension controlling agents, resistivity controlling agents, layer forming agents, dispersing agents, surface active agents, UV absorbers, antioxidants, anti-discoloring agents, rust inhibitors, and antiseptic agents may be suitably incorporated in said ink compositions, depending on the intent to improve the ejection stability, the adaptability of printing heads and ink cartridges, the storage stability, and the image retention properties.

Addition of fine thermoplastic particles is particularly preferred to result in the desired effects of the present invention. Employed as said fine thermoplastic particles may be those which can be incorporated in the surface layer of the aforesaid recording materials, or types of those described in the aforesaid fine particles. Specifically, it is preferable to employ those which result in neither an increase in viscosity nor precipitation, when added to ink. The average diameter of said thermoplastic particles is preferably less than or equal to 0.5 $\mu$m, and is more preferably in the range of 0.2 to 2.0 times of average diameter of pigment particles in the ink, from the viewpoint of stability. Fine thermoplastic particles, to be added, preferably melt or soften in the range of 50 to 200° C.

The viscosity of said ink compositions during its injection is preferably less than or equal to 40 mPa·s, and is more preferably less than or equal to 30 mPa·s.

The surface tension of said ink compositions during its ejection is preferably at least 20 mN/m, and is more preferably from 30 to 45 mN/m.

The selectable range of solid concentration of pigments in ink is from 0.1 to 10.0 percent by weight. In order to obtain images approaching conventional photography, it is preferable to employ so-called dense and pale inks in which the solid concentration of pigments are individually varied. It is particularly preferable to employ said dense and pale inks for each of yellow, magenta, cyan, and black. Further, if desired, it is preferable to employ specified color inks such as red, green, and blue.

<Thermal Fixing Apparatus>

The thermal fixing apparatus of the present invention will now be described.

In order to result in effects described in the present invention, namely to prepare images with desired glossiness after fixing, the thermal fixing apparatus, according to the present invention, is characterized in being comprised of at least one of the Fixing belt and the fixing roller according to the present invention as a constituting component.

During the thermal fixing process, it is desired that energy be provided to images so that the effects of the present invention are fully exhibited. Heating temperature, especially in the case of pigment images, may be one capable of smoothing images, is preferably in the rang of 60 to 200° C., and is more preferably in the range of 80 to 160° C.

Heating may be carried out employing a heating unit installed in the printer or independently provided. In either case of employing said fixing roller or said fixing belt, it is preferable to employ heating rollers as a heating means so that unevenness is minimized and continuous processing can be carried out in a small space. Further, said unit is advantageous in terms of cost, since thermal fixing units employed in electrophotographic apparatuses may be employed as said unit.

Said heating roller comprises a hollow roller as a constituent component and is rotated by a driving means. It is preferable that a heat generating device comprised of, for example, a halogen lamp heater, a ceramic heater, or a nichrome wire heater is provided in the hollow section.

Further, said roller is preferably comprised of materials having a high thermal conductivity. Of these, metal rollers are particularly preferred and of these, a nickel roller is preferably employed.

When such a fixing belt or fixing roller is employed, the transport rate of recording materials is preferably in the range of 1 to 100 mm/second, and is more preferably in the range of 10 to 50 mm/second. Said rate is preferred from the viewpoint of image quality in addition to high speed processing.

In order to achieve higher sensation in quality as well as higher gloss, it is preferable that pressing is carried out at the same time of or immediately after heating. Pressing pressure is preferably in the range of $9.8\times10^4$ to $4.9\times10^6$ Pa, since higher pressure accelerates film formation.

<Image Forming Method>

The image forming method of the present invention will now be described.

The image forming method of the present invention is characterized in that during fixing of images, the thermal fixing apparatus, according to the present invention, is employed. In the present invention, for example, when images are formed employing a pigment ink for ink-jet recording, printers are not particularly limited as long as said printers comprise a recording material storing section, a transport section, an ink cartridge, and an ink-jet recording head as seen in commercially available printers. However, a printer comprising, in addition, a set of the following sections is useful when ink-jet prints are used commercially: at least a rolled recording material storing section, a transport section, an ink-jet recording head, a cutter section, and if desired, a heating section, a pressing section, and a recorded print storing section.

Said printing head may use any of the piezoelectric system, the thermal system or the continuous system. However, from the viewpoint of stability of pigment ink, the piezoelectric system is preferred.

It is preferable that the C value described below is increased after printing, employing any of the available processes described below. Said available processes include those in which images are heated or pressed, or images are subjected to both; or solvents or plasticizers are provided and additional heating is carried out; or thermoplastic resin components are provided onto images and additional heating is carried out. Further, such processes may be combined with each other and said processes may be carried out a plurality of times.

Further, in the image forming method of the present invention, it is preferable that after printing images onto a recording material, employing a pigment ink, said recording material is thermally fixed employing the thermal fixing apparatus of the present invention. In said image forming method, it is preferable that pigment images, in which pigments and thermoplastic resins are mixed or which are located near said pigments and thermoplastic resins, are subjected to thermal fixing process. In such a case, it is preferable that said thermoplastic resins partially or completely melt and further form a layer.

Listed as methods in which pigment images are allowed to exist together with thermoplastic resins are: 1) a recording material is employed which comprises thermoplastic resins, or preferably fine thermoplastic particles, 2) prior to or after printing, thermoplastic resins are provided onto said recording material, and 3) thermoplastic resins are incorporated in said pigment ink.

In the present invention, the image definition called C value is preferably at least 60. Said C value, as described herein, refers to the value determined by the reflection method employing a 2 mm optical comb of image definitions specified in JIS K 7105. Said C value is defined as the scale of image clarity.

Image clarity, as described in the present invention, represents the capability of the layer surface which transfers the image of a body facing the layer surface, namely the value which shows how accurately an incident image is reflected or projected on the image surface. The more accurate the reflection images are provided, with respect to the incident image, the higher the image transfer properties become, and as a result, said C value increases. Said C value represents combined effects of specular glossiness and surface smoothness. The higher the reflectance and the higher the smoothness, the more said C value increases.

The inventors of the present invention investigated various pigment images prepared by ink-jet recording, having different C values and discovered that along with an increase in said C value, gloss increases, and it was possible to prepare images nearly equal to conventional silver halide photography. Further, surprisingly, along with an increase in said C value, it was discovered that bronzing phenomena, which were specific to pigment ink was minimized. Still further, along with an increase in said C value, it was discovered that image retaining properties such as water-fastness as well as acidic gas resistance was improved.

Pigments images having a C value of at least 60 are capable of resulting the effects which are the aim of the present invention. However, said C value is preferably from 70 to 90, and is more preferably from 75 to 90.

Methods to achieve a C value of at least 60, specified in the present invention, are not particularly limited. For example, after printing images onto a recording material employing ink pigments, it is possible to obtain the target C value employing methods in which after printing images onto a printing material employing ink pigment, the resultant images are heated or pressed, or said images are subjected to both processes; or solvents or plasticizers are provided onto images and additional heating is carried out; or thermoplastic resin components are provided onto images and additional heating is carried out. Further, such processes may be combined with each other or said processes may be carried out a plurality of times.

EXAMPLES

The present invention will now be described with reference to examples. However, the present invention is not limited to these examples.

Example 1

<<Production of Fixing Belt>>

<Production of Fixing Belt Sample 1>

A base-surface modifying layer was coated by use of the following base-surface modifying layer coating solution on a base material (seamless nickel electro-formed belt), followed by coating an adhesive layer by use of the following adhesive layer coating solution; subsequently a releasing layer was coated thereon to produce fixing belt sample 1. Preparation of a base-surface modifying layer coating solution; for 1920 ml:

| | |
|---|---|
| Aluminum coupling agent Plainact AL-M (manufactured by Kawaken Fine Chemicals Co., Ltd.) | 120 g |
| Toluene | 1800 ml |

Above raw materials were mixed and stirred to prepare a base-surface modifying layer coating solution.

<Coating of a Base-Surface Modifying Layer>

The foregoing base-surface modifying layer coating solution was charged in a cylindrical beaker having 15 cm of a inside diameter×50 cm of a height, and a seamless nickel electro-formed belt (Ra 0.06 μm, surface C value 98, 65 mm diametral, 240 mm long, 40 μm thick: produced by Nitto-Kogyo Co., Ltd.) was set on a dip type coater available on the market, followed by being immersed in a beaker by ascending the belt. Next coating was performed at a pulling-up speed of 4 mm/sec, and after being kept at room temperature for 3 minutes it was heated in an oven at 140° C. for 1 hour to prepare a base-surface modifying layer.

<Preparation of an Adhesive Layer Coating Solution; for 2 Litter>

| | |
|---|---|
| Denkabutyral 6000C (manufactured by Denki-Kagakukogyo Co., Ltd.) | 10 g |
| Ethyl acetate | 1790 ml |
| n-Butanol | 200 ml |
| Silane coupling agent KBM503 (manufactured by Shinetsu-Kagakukogyo Co.) | 1.6 ml |

The above raw materials were mixed and stirred for 3 hours, and Denkabutyral was completely dissolved to prepare an adhesive layer coating solution.

<Coating of an Adhesive Layer onto a Base-Surface Modifying Layer>

The foregoing adhesive layer coating solution was charged in a cylindrical beaker having 15 cm of a inside diameter×50 cm of a height, and a seamless nickel electro-formed belt provided with the foregoing base-surface modifying layer was set on a dip type coater available on the market followed by being immersed in a beaker by ascending the belt.

Next coating was performed at a pulling-up speed adjusted to 4 mm/sec, and after being kept at room temperature for 3 minutes it was heated in a oven at 100° C. for 30 minutes to prepare an adhesive layer.

<Preparation of a Releasing Layer Coating Solution; for 2 Litter>

| | |
|---|---|
| Peeling agent for delaminatable paper KS830E (manufactured by Shinetsu-Kagakukogyo Co., Ltd.) | 500 g |
| Hardening catalyst CAT-PL-50T (manufactured by Shinetsu-Kagakukogyo Co., Ltd.) | 5 ml |
| Toluene | 1500 ml |

The above raw materials were mixed and stirred to prepare a releasing layer coating solution.

<Coating of a Releasing Layer on an Adhesive Layer>

The foregoing releasing layer coating solution for 2 litter was charged in a cylindrical beaker having 15 cm of a inside diameter×50 cm of a height, and a seamless nickel electro-formed belt provided with the foregoing adhesive layer was set on a dip type coater available on the market, followed by being immersed in a beaker by ascending the belt. Next coating was performed at a pulling-up speed adjusted to 15 mm/sec, and after being kept at room temperature for 5 minutes it was heated in a oven at 100° C. for 1 hour to prepare a releasing layer.

<Hydrolysis and Condensation Process>

A belt coated with a releasing layer was kept for aging at 40° C. and 80% RH for 12 hours, and was further heated at 140° C. for 15 hours to produce fixing belt sample 1.

<Production of Fixing Belt Samples 2 to 11>

Fixing belt samples 2 to 11 each were produced in a similar manner to production of fixing belt sample 1 except that pencil hardness was changed as described in Table 1 by adjusting the hydrolysis condition and heating time.

Each of the condition of the hydrolysis and the heating time is called as an aging condition from 1 to 11.

<Production of Fixing Belt Samples 12 to 22>

Fixing belt samples 12 to 22 each were produced in a similar manner to production of fixing belt sample 1 except that they were not coated with an adhesive layer nor a releasing layer after coating a base-surface modifying layer on the base material. The samples 12 to 22 were prepared by applying to the same the condition of the hydrolysis and the heating time for samples 1 to 11 respectively.

Each of fixing belt samples 1 to 22 thus obtained was evaluated as follows.

<<Evaluation of Pencil Hardness of a Base-Surface Modifying Layer of a Fixing Belt>>

The base-surface modifying layer of the fixing belt samples 12 to 22 were subjected to a pencil hardness evaluation. It was found that there were no difference of a pencil hardness between the followings:

(1) the base-surface modifying layer of the fixing belt samples 12 to 22; and (2) the surface of the base material of samples 1 to 11 being peeled off the releasing layer and the adhesion layer of the samples 1 to 11.

As for evaluation of a fixing belt, pencil hardness evaluation of a base-surface modifying layer was performed at a stage of the base-surface modifying layer having been coated on a seamless nickel electro-formed belt as evaluation of a belt alone. Further, as for image evaluation employing a fixing belt, adhesion durability of the releasing layer of the fixing belt and glossiness of fixed images were evaluated, by preparing an ink jet recording material and an ink jet ink, and by arranging the fixing belt samples 1 to 11 according to a constitution as illustrated in FIG. 1.

<<Pencil Hardness Test Method>>

Hardness evaluation was performed according to JIS K 5600-5-4. A pencil utilized in the test was "uni" (produced by Misubishi-Enpitsu Co., Ltd.). Pencil hardness of the base-surface modifying layer was measured according to the handwriting method described in JIS K 5600-5-4. A hardness rank lower by one than the rank (wherein, "lower" means a lower hardness side), at which a base-surface modifying layer was torn to expose the surface of nickel base material, was shown in Table 1.

<<Preparation of Ink Jet Recording Material>>

After preparing each dispersion employing the formula described below, an ink jet recording material was prepared employing each of the resultant dispersions.

<Preparation of Silica Dispersion 1>

Suction-dispersed 125 kg of gas phase method produced silica (QS-20, manufactured by Tokuyama Co., Ltd.), having an average diameter of primary particles of 0.012 $\mu$m, was into 620 L of pure water of which pH was adjusted to 2.5 by adding nitric acid, employing Jet Stream Inductor Mixer TDS, manufactured by Mitamura Riken Kogyo Co., Ltd. Subsequently, the total volume of the resultant dispersion was adjusted to 694 L by adding pure water. The resultant dispersion was designated as Silica Dispersion 1.

<Preparation of Silica Dispersion 2>

Under stirring, 69.4 L of Silica Dispersion 1 was added to 18 L of an aqueous solution (at a pH of 2.3) consisting of 1.14 kg of Cationic Polymer (P-1), 2.2 L of ethanol, and 1.5 L of n-propanol, and subsequently, 7.0 L of an aqueous solution comprising 260 g of boric acid and 230 g of borax was added, and 1 g of antifoaming agent SN381 (manufactured by Sun Nopco Co., Ltd.) was also added.

The resultant mixture was dispersed employing a high pressure homogenizer, manufactured by Sanwa Kogyo Co., Ltd., and the total volume of the resultant dispersion was adjusted to 97 L by adding pure water, whereby Silica Dispersion 2 was prepared.

P-1

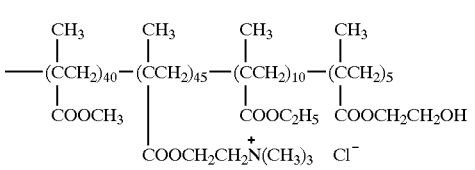

<Preparation of Silica Coating Composition>

Subsequently, the silica coating composition, described below, was prepared employing Silica Dispersion 2 prepared as above.

While stirring, the additives described below were successively added to 600 ml of Silica Dispersion 2.

(1) 6 ml of 10 percent aqueous solution of polyvinyl alcohol (PVA 203, manufactured by Kuraray Kogyo Co., Ltd.), (2) 185 ml of 7 percent aqueous solution of polyvinyl alcohol (PVA 235 manufactured by Kuraray Kogyo Co., Ltd.), and subsequently (3) the total volume was adjusted to 1,000 ml by adding pure water.

<Fine Thermoplastic Particle Coating Composition>

The pH of a styrene-acryl based latex polymer (having a Tg of 78° C., an average particle diameter of 250 nm, and a solid concentration of 40 percent), prepared by emulsion polymerization employing polyvinyl alcohol as a nonionic emulsifier, was adjusted to 4.7, by adding 6 percent aqueous nitric acid solution, whereby a fine styrene-acryl based thermoplastic particle coating composition was prepared.

<Preparation of Fine Composite Particle Coating Composition>

A fine composite particle coating composition was prepared by blending said fine thermoplastic particle coating composition with said silica coating composition so that the resultant solid weight ratio was 2/1.

<Preparation of Ink-jet Recording Material 1>

Said silica coating composition and said fine composite particle coating composition in the order viewed from the polyethylene coated paper, described below, were simultaneously applied onto said polyethylene coated paper so as to obtain a wet coating thickness of 120 $\mu$m and 120 $\mu$m, respectively. The resultant coating was temporarily cooled to approximately 7° C. and subsequently was dried employing a 20 to 65° C. airflow, whereby Ink-jet Recording Material 1 was prepared. Said polyethylene coated paper was comprised of a 170 g/m$^2$ base paper coated with polyethylene on both sides (8 weight percent of anatase type titanium dioxide was incorporated in the polyethylene on the ink receptive layer side; 0.05 g/m$^2$ gelatin sublayer was provided on the ink receptive layer side; and on the opposite side, provided was a backing layer comprised of latex polymers of a Tg of approximately 80° C. at a coating weight of 0.2 g/m$^2$).

<<Preparation of Ink for Ink-Jet Recording>>

Ink compositions were prepared as described below.

| Yellow Pigment Dispersion: | |
|---|---|
| C.I. Pigments Yellow 74 | 95 g |
| Demol C (manufactured by Kao Corp.) | 65 g |
| Ethylene glycol | 100 g |
| Deionized water | 120 g |

was blended and dispersed employing a sand grinder filled with 0.5 mm zirconia beads at a volume ratio of 50 percent, whereby a yellow pigment dispersion was prepared. The average particle diameter of the obtained pigment dispersion was 122 nm. Incidentally, the particle diameter was determined employing a Zeta Sizer 1000, manufactured by Malvern Instruments Inc.

| Magenta Pigment Dispersion: | |
|---|---|
| C.I. Pigments Red 122 | 105 g |
| Johncryl 61 (acryl-styrene based resin, manufactured by Johnson Corp.) | 60 g |
| Glycerin | 100 g |
| Deionized water | 130 g |

was blended and dispersed employing a sand grinder filled with 0.5 mm zirconia beads at a volume ratio of 50 percent, whereby a magenta pigment dispersion was prepared. The average particle diameter of the obtained pigment dispersion was 85 nm.

| Cyan Pigment Dispersion: | |
|---|---|
| C.I. Pigment Blue 15:3 | 100 g |
| Demol C | 68 g |

-continued

| Cyan Pigment Dispersion: | |
|---|---|
| Diethylene glycol | 100 g |
| Deionized water | 125 g |

was blended and dispersed employing a sand grinder filled with 0.5 mm zirconia beads at a volume ratio of 50 percent, whereby a cyan pigment dispersion was prepared. The average particle diameter of the obtained pigment dispersion was 105 nm.

| <Preparation of Yellow Ink> | |
|---|---|
| Yellow Pigment Dispersion | 113 g |
| Ethylene glycol | 100 g |
| Glycerin | 72 g |
| Pelex OT-P (manufactured by Kao Corp.) | 3 g |
| Proxel GXL (manufactured by Zeneca Corp.) | 0.2 g |
| Deionized water to make | 1000 g |

The resultant mixture was stirred well, and yellow ink was prepared by twice passing said mixture through a Millipore Filter having a pore diameter of one micron. The pH of the ink was 8.2.

| <Preparation of Cyan Ink> | |
|---|---|
| Cyan Pigment Dispersion | 113 g |
| Ethylene glycol | 100 g |
| Glycerin | 72 g |
| Pelex OT-P (manufactured by Kao Corp.) | 3 g |
| Proxel GXL (manufactured by Zeneca Corp.) | 0.2 g |
| Deionized water to make | 1000 g |

The resultant mixture was stirred well, and cyan ink was prepared by twice passing said mixture through a Millipore Filter having a pore diameter of one micron. The pH of the ink was 8.3.

| <Preparation of Magenta Ink> | |
|---|---|
| Magenta Pigment Dispersion | 113 g |
| Ethylene glycol | 100 g |
| 1,2-Hexanediol | 100 g |
| Pelex OT-P (manufactured by Kao Corp.) | 3 g |
| Proxel GXL (manufactured by Zeneca Corp.) | 0.2 g |
| Deionized water to make | 1000 g |

The resultant mixture was stirred well, and magenta ink was prepared by twice passing said mixture through a Millipore Filter having a pore diameter of one micron. The pH of the ink was 8.5.

| <Preparation of Black Ink> | |
|---|---|
| Hostfine Black T (having an average particle diameter of 50 nm, manufactured by Clariant Co., Ltd.) | 167 g |
| 1,2-Hexanediol | 150 g |

-continued

| <Preparation of Black Ink> | |
|---|---|
| Ethylene glycol | 220 g |
| Diethylene glycol | 90 g |
| LEVENOL WX (manufactured by Kao Corp.) | 3 g |
| Proxel GXL (manufactured by Zeneca Corp.) | 0.2 g |
| Deionized water to make | 1000 g |

The resultant mixture was stirred well, and magenta ink was prepared by twice passing said mixture through a Millipore Filter having a pore diameter of one micron. The pH of the ink was 8.6.

<<Preparation of Image Samples 1 through 11>>

Each of Fixing Belts 1 through 11, prepared as above, was installed in an ink-jet printer fitted with the thermal fixing apparatus described in FIG. 9. Employing ink for ink-jet recording, a solid black image was printed onto ink-jet recording material 1 and was thermally fixed employing the fixing apparatus in said printer, whereby Image Samples 1 through 11 were prepared. The temperature of the heating roller, which transmits heat onto the fixing belt, was set at 120° C.

<<Evaluation of Adhesion Durability of a Fixing Belt>>

A solid cyan image was printed on a medium and was fixed after being cut out as a strip sheet of 30 mm wide and 127 mm long. After repeated fixing of 150 sheets (specified number of sheets) was performed the fixing belt was detached from an apparatus, being cooled to room temperature (25±5° C.); thereafter, an adhesive tape (Nitto Polyester Tape No. 31B (manufactured by Nitto-Denko Co., Ltd.)) was adhered on a portion used in fixing without including air between a surface layer and an adhesive layer, and was peeled off at a speed of 3 mm/sec and at an angle of 180 degrees. The peel-off test was repeated 4 times by changing places. The degree of layer peeling in the 30 mm wide tape was visually evaluated based on the ranks described below.

A: no layer peeling

B: a layer peeling portion was noticed

C: plural layer peeling portions appeared

D: a layer peeling portion of not smaller than 1 cm square appeared wherein, rank C and better ranks are acceptable for practically use.

The results obtained are shown in Table 1.

<<Evaluation of Glossiness>>

The image clarity (glossiness C value in percent) of each of Image Samples 101 through 113 was determined at a reflection angle of 60 degrees and an optical comb of 2 mm, employing an image clarity meter ICM-IDP (manufactured by Suga Shikenkikai Co., Ltd.). Evaluation was performed based on the criteria described below.

The experimental results are listed in Table 1.

TABLE 1

| | Fixing belt employed for image sample preparation | | | Fixing belt employed for measuring a pencil hardness | | |
|---|---|---|---|---|---|---|
| Aging condition No. | Sample No. | Adhesion durability | Glossiness of an image sample | Sample No. | Pencil hardness of a base-surface modifying layer | Remarks |
| 1 | 1 | D | 42 | 12 | 5B | Comp. |
| 2 | 2 | D | 45 | 13 | 4B | Comp. |
| 3 | 3 | D | 48 | 14 | 3B | Comp. |
| 4 | 4 | D | 47 | 15 | 2B | Comp. |
| 5 | 5 | D | 50 | 16 | B | Comp. |
| 6 | 6 | C | 72 | 17 | HB | Inv. |
| 7 | 7 | B | 75 | 18 | H | Inv. |
| 8 | 8 | A | 82 | 19 | 2H | Inv. |
| 9 | 9 | A | 85 | 20 | 3H | Inv. |
| 10 | 10 | A | 86 | 21 | 4H | Inv. |
| 11 | 11 | A | 85 | 22 | 5H | Inv. |

Comp.; Comparison
Inv.; Invention

It is clear from Table 1 that a fixing belt of the present invention of which a base-surface modifying layer is adjusted to have a pencil hardness of HB or more, compared to the comparative samples, has excellent adhesion durability of a surface layer at fixing treatment in image formation as well as excellent glossiness.

Example 2

Production of Fixing Belt Samples 23 to 30

Fixing belt samples 23 to 30 each were prepared in a similar manner to production of fixing belt sample 1 except that a swelling rate (%) of a base-surface modifying layer is adjusted to be as described in Table 2.

<<Production of Fixing Belts 31 to 38>>

Fixing belt samples 31 to 38 each were produced in a similar manner to production of fixing belt sample 1, by applying similar treatments under the hydrolysis condition and condensation time which had been applied to each fixing belt 23 to 30, without providing an adhesive layer and a releasing layer after a base material modifying layer was coated. The said hydrolysis condition and heating time each were set to aging conditions 23 to 30.

Each of fixing belt sample 23 to 38 prepared was evaluated as follows.

<<Swelling Rate of a Base Material Modifying Layer>>

In accordance with a weight variation test by immersion described in JIS K 6258, fixing belts 31 to 38 were cut into a prescribed size to be subjected to the test by being immersed completely in the aforementioned cyan ink instead of distilled water. The immersion temperature was 23° C. and the immersion time was 22 hours.

<<Measurement of Glossiness Change>>

Glossiness (initial glossiness) was measured, in a similar manner to as described in example 1, using each fixing belt sample 12 to 19 obtained. Further, after fixing images of 1000 sheets of the ink jet recording material described in example 1, glossiness of an image of the 1000th sheet after fixing was measured by a similar method. The difference between an initial glossiness and a glossiness of the 1000th sheet was evaluated according to the following ranking.

A: no difference between an initial glossiness and a glossiness of the 1000th sheet B: difference between an initial glossiness and a glossiness of the 1000th sheet is not more than 1

C: difference between an initial glossiness and a glossiness of the 1000th sheet is more than 1 and not more than 2

D: difference between an initial glossiness and a glossiness of the 1000th sheet is more than 2 wherein, rank C and better ranks are acceptable for practical use.

Results obtained are shown in Table 2.

TABLE 2

| | Fixing belt employed for image sample preparation | | | | Fixing belt employed for swelling measurement | | |
|---|---|---|---|---|---|---|---|
| Aging condition | Sample No. | Initial glossiness | Glossiness of 1000th sheet | Variation of glossiness | Sample No. | Swelling rate of a base-surface modifying later | Remarks |
| 23 | 23 | 48 | 44 | D | 31 | 7 | Comp. |
| 24 | 24 | 48 | 43 | D | 32 | 6 | Comp. |
| 25 | 25 | 51 | 46 | D | 33 | 5 | Comp. |
| 26 | 26 | 72 | 70 | C | 34 | 4 | Inv. |
| 27 | 27 | 75 | 74 | B | 35 | 3 | Inv. |
| 28 | 28 | 82 | 81 | B | 36 | 2 | Inv. |
| 29 | 29 | 85 | 85 | A | 37 | 1 | Inv. |
| 30 | 30 | 86 | 76 | A | 38 | 0 | Inv. |

Comp.; Comparison
Inv.; Invention

It is clear from Table 2 that samples having a swelling rate less than 5% exhibit small difference between an initial glossiness and a glossiness of the 1000th sheet.

Example 3

<<Production of Fixing Belts 39 to 44>>

Fixing belt 39 to 44 were produced in a similar manner to the production of fixing belt sample 1, except that a base material modifying layer, presence or absence of an adhesive layer, a kind of an adhesive layer and an addition amount of a silane coupling agent were adjusted to those described in Table 3.

<<Long Run Durability>>

Fixing belt samples 39 to 44 each were set in the ink jet printer equipped with a heat fixing device, described in FIG. 9, and after print having ordinary photographic image quality being performed on an ink jet recording material described in Example 1 by use of the ink jet ink, the recording material was subjected to a heat fixing treatment through the fixing device in the apparatus. The temperature of the belt was set to 120° C. and the pressure to 1 MPa. The fixing speed was 10 mm/sec based on a speed of recording material.

The fixing operation was performed continuously and within a minute after printing. The layer surface was observed at every 50 sheets fixing and the number of sheets fixed when layer peeling of not smaller than 5 mm square was generated was recorded.

The obtained results are shown in Table 3.

TABLE 3

| Fixing belt sample No. | Re-leasing layer | Base-surface modifying layer | Adhe-sive layer | Silan coupling agent | Amount of silane cou-pling agent | Long-run dura-bility: sheet number |
|---|---|---|---|---|---|---|
| 39 | KS830E | No | No | No | No | 50 |
| 40 | KS830E | Plain act AL-M | No | No | No | 12400 |
| 41 | KS830E | Plain act AL-M | PVA224 | No | No | 15500 |
| 42 | KS830E | Plain act AL-M | Butyral 6000C | No | No | 45000 |

TABLE 3-continued

| Fixing belt sample No. | Re-leasing layer | Base-surface modifying layer | Adhe-sive layer | Silan coupling agent | Amount of silane cou-pling agent | Long-run dura-bility: sheet number |
|---|---|---|---|---|---|---|
| 43 | KS830E | Plain act AL-M | Butyral 6000C | KBM603 | 1.6 g | 51000 |
| 43 | KS830E | Plain act AL-M | Butyral 6000C | KBM503 | 1.6 g | 125000 |
| 44 | KS830E | Plain act AL-M | Butyral 6000C | KBM503 | 4.8 g | at least 200000 |

It was found that the durability is larger when the sample has an adhesive layer and a butyral resin gave an advantageous effect. An addition of a silane coupling agent was preferable and it was proved that a silane coupling agent having a terminal vinyl group was more preferable.

Example 4

<<Production of Fixing Belts 45 to 50>>

Fixing belt samples 45 to 50 were produced in a similar manner to the production of fixing belt sample 1, except that a base material utilized for the production was changed to ones described in Table 4.

<<Evaluation of Glossiness>>

Glossiness was measured in a similar manner to the description of Example 1 with respect to fixing belt samples 45 to 50 prepared.

The C values were measures in the same way as for Example 1. The 60 degree specular gloss was measured using the same samples.

<<Measurement of 60 Degree Specular Gloss>>

The 60 degree specular gloss was measured according to the method defined in JIS Z 7105. The measurement value was determined as an average value of 5 repeated measurements.

The obtained results are shown in Table 4.

TABLE 4

| Fixing belt sample No. | Base material | Mechanical Property: Durometer hardness | Mechanical Property: C value of a base material | Glossiness of an image: C value | Glossiness of an image: 60 degree speculor glossiness |
|---|---|---|---|---|---|
| 45 | Polyimide | 40 | 75 | 45 | 58 |
| 46 | Silicone rubber | 20 | 80 | 42 | 62 |
| 47 | Silicone rubber | 70 | 80 | 48 | 68 |
| 48 | Nickel (Sandblast treated) | 91 | 48 | 42 | 118 |
| 49 | Nickel | 92 | 85 | 82 | 125 |
| 50 | Nickel | 93 | 95 | 92 | 132 |

It was found that a durometer hardness is preferably not less than 90. It was also found that a C value of the base material is preferably not less than 85, and more preferably not less than 90.

The present invention is capable of providing a fixing belt and a fixing roller which result in high image stability and excellent gloss of images after fixing with a small amount of glossiness change, a production method of the same, a thermal fixing apparatus, and an image forming method.

What is claimed is:

1. A fixing member for fixing an ink jet image recorded on an ink jet recording material, the fixing member comprising a base material having thereon a base surface modifying layer and a releasing layer in that order, wherein the base surface modifying layer has a pencil hardness of HB or a higher hardness and the releasing layer comprises a silicone resin.

2. A fixing member of claim 1 for fixing an ink-jet image recorded on an ink-jet recording material, the fixing member comprising a belt having base material having thereon a base-surface modifying layer and a releasing layer in the order, wherein the base-surface modifying layer has a pencil hardness of HB or a higher hardness and the releasing layer comprises a silicone resin.

3. The fixing member of claim 2, wherein the releasing layer has a durometer hardness defined by JIS K 6253 of not less than 90.

4. The fixing member of claim 3, wherein an adhesive layer is further provided between the base-surface modifying layer and the releasing layer.

5. The fixing member of claim 4, wherein the adhesive layer comprises a butyral resin.

6. The fixing member of claim 5, wherein the adhesive layer comprises a silane coupling agent.

7. The fixing member of claim 6, wherein the silane coupling agent has a terminal vinyl group.

8. The fixing member of claim 3, wherein the base material comprises electric forming nickel and forms a seamless belt.

9. The fixing member of claim 1 wherein the fixing member is a fixing belt or a fixing roller.

10. A fixing belt for fixing an inkjet image recorded on an ink jet recording material, the fixing belt comprising:

a base material having thereon a base surface modifying layer and a releasing layer in that order, wherein the base surface modifying layer has a pencil hardness of HB or a higher hardness, the releasing layer comprises a silicone resin, and the base-surface modifying layer has a swelling rate in an ink-jet for ink-jet recording of less than 5 weight %.

11. A fixing belt for fixing an inkjet image recorded on an ink jet recording material, the fixing belt comprising:

a base material having thereon a base surface modifying layer and a releasing layer in that order, wherein the base surface modifying layer has a pencil hardness of HB or a higher hardness, the releasing layer comprises a silicone resin, and the base-surface modifying layer comprises an aluminum coupling agent or a zirconium coupling agent.

12. A fixing belt for fixing an inkjet image recorded on an ink jet recording material, the fixing belt comprising:

a base material having thereon a base surface modifying layer and a releasing layer in that order, wherein the base surface modifying layer has a pencil hardness of HB or a higher hardness, the releasing layer comprises a silicone resin, and the base material has a Young's modulus value of 50 to 300 $kN/mm^2$.

13. The fixing belt of claim 12, wherein the releasing layer has a C value of not less than 85.

* * * * *